US010031432B2

(12) United States Patent
Mizuhata et al.

(10) Patent No.: US 10,031,432 B2
(45) Date of Patent: Jul. 24, 2018

(54) PROCESS FOR MANUFACTURING TONER FOR DEVELOPING ELECTROSTATIC IMAGE

(71) Applicant: KAO CORPORATION, Tokyo (JP)

(72) Inventors: Hiroshi Mizuhata, Wakayama (JP); Koji Shimokusa, Wakayama (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 14/909,311

(22) PCT Filed: Jun. 13, 2014

(86) PCT No.: PCT/JP2014/065803

§ 371 (c)(1),
(2) Date: Feb. 1, 2016

(87) PCT Pub. No.: WO2015/015927

PCT Pub. Date: Feb. 5, 2015

(65) Prior Publication Data

US 2016/0179021 A1 Jun. 23, 2016

(30) Foreign Application Priority Data

Aug. 1, 2013 (JP) ..... 2013-160287

(51) Int. Cl.
*G03G 9/087* (2006.01)
*G03G 9/08* (2006.01)

(52) U.S. Cl.
CPC ..... *G03G 9/0804* (2013.01); *G03G 9/0819* (2013.01); *G03G 9/08755* (2013.01); *G03G 9/08782* (2013.01)

(58) Field of Classification Search
CPC ..... G03G 9/0802; G03G 9/0804
See application file for complete search history.

(56) References Cited

U.S. PATENT DOCUMENTS

| | | | | |
|---|---|---|---|---|
| 5,593,807 | A | 1/1997 | Sacripante et al. | |
| 2003/0232268 | A1* | 12/2003 | Sacripante | C08J 3/16 430/137.14 |
| 2008/0090163 | A1* | 4/2008 | Agur | G03G 9/0804 430/108.1 |
| 2008/0131804 | A1* | 6/2008 | Kamiyoshi | G03G 9/0804 430/110.2 |
| 2011/0229816 | A1* | 9/2011 | Shirai | G03G 9/08755 430/109.4 |
| 2012/0100476 | A1* | 4/2012 | Jang | G03G 9/09321 430/108.2 |
| 2012/0251940 | A1 | 10/2012 | Suzuki et al. | |
| 2013/0295499 | A1 | 11/2013 | Murata et al. | |
| 2013/0316284 | A1 | 11/2013 | Mizuhata | |
| 2015/0277250 | A1 | 10/2015 | Shidahara et al. | |

FOREIGN PATENT DOCUMENTS

| | | | |
|---|---|---|---|
| JP | 10-39545 | A | 2/1998 |
| JP | 2008-097004 | A | 4/2008 |
| JP | 2009-134061 | A | 6/2009 |
| JP | 2010-169702 | A | 8/2010 |
| JP | 2012-128024 | A | 7/2012 |
| JP | 2014-89442 | A | 5/2014 |
| WO | WO 2011/078410 | A1 | 6/2011 |
| WO | WO 2012/086523 | A1 | 6/2012 |
| WO | WO 2012/086688 | A1 | 6/2012 |

OTHER PUBLICATIONS

Extended European Search Report dated Feb. 23, 2017 in Patent Application No. 14831459.4.
U.S. Appl. No. 14/432,884, filed Apr. 1, 2015, 2015/0277250, Yasuhiro Shidahara et al.
International Search Report dated Jul. 8, 2014, in PCT/JP2014/065803 filed Jun. 13, 2014.

* cited by examiner

*Primary Examiner* — Peter L Vajda
(74) *Attorney, Agent, or Firm* — Oblon, McClelland, Maier & Neustadt, L.L.P.

(57) ABSTRACT

According to the present invention, there are provided a process for producing a toner for development of electrostatic images which is capable of suppressing desorption and exposure of a releasing agent therein, and excellent in fusing property, suppression of toner cloud and durability; a process for producing a dispersion, and a kit for producing the dispersion. The present invention relates to a process for producing a toner for development of electrostatic images which includes the following steps (1) to (3): step (1) of mixing and emulsifying a releasing agent and a dispersion of resin particles (A) containing a polyester in an amount of not less than 90% by mass on the basis of a resin component in the resin particles (A) to obtain a dispersion of releasing agent particles; step (2) of mixing and aggregating the dispersion of the releasing agent particles obtained in the step (1) and a dispersion of resin particles (B) containing a polyester in an amount of not less than 90% by mass on the basis of a resin component in the resin particles (B) to obtain aggregated particles; and step (3) of coalescing the aggregated particles obtained in the step (2) to obtain coalesced particles, in which an acid component constituting the polyester in the resin particles (A) contains an aliphatic carboxylic acid; the resin particles (A) have a volume median particle size of not less than 0.02 μm and not more than 0.50 μm; and a content of a surfactant in the dispersion of the releasing agent particles is not more than 0.5 part by mass on the basis of 100 parts by mass of the releasing agent; a process for producing the dispersion of the releasing agent particles which includes the above step (1); and a kit for producing the dispersion of the releasing agent particles.

19 Claims, No Drawings

PROCESS FOR MANUFACTURING TONER FOR DEVELOPING ELECTROSTATIC IMAGE

FIELD OF THE INVENTION

The present invention relates to a process for producing a toner for development of electrostatic images.

BACKGROUND OF THE INVENTION

In recent years, in the field of toners for electrophotography, with the progress of electrophotographic systems, it has been demanded to develop toners adaptable for high image quality and high copying or printing speed. From the viewpoint of the high image quality, the toners have been required to have a small particle size. Thus, there have been disclosed processes for producing a so-called chemically prepared toner by a chemical method such as a suspension polymerization method, an emulsion polymerization method and a dissolution suspension method in place of the conventional melt-kneading method. Further, from the viewpoint of the high copying or printing speed, there has been reported a chemically prepared toner to which a releasing agent is internally added in order to improve low-temperature fusing property thereof.

For example, Patent Literature 1 discloses a toner including core particles produced by aggregating at least resin particles, colorant particles and wax particles, in which a dispersant used in a dispersion of the wax particles contains a polypropylene glycol ethyleneoxide adduct. Patent Literature 1 also describes that the problem that the wax particles or the colorant particles are not aggregated with the other components of the core particles in an aqueous system and therefore remain unincorporated into the core particles can be solved, so that it is possible to produce toner particles having a narrow particle size distribution and a small particle size.

Patent Literature 2 discloses a process for producing a toner including the steps of mixing resin particles containing a polyester as a main component, releasing agent particles containing a wax and a polyester resin having a specific softening point at a specific weight ratio, and an aggregating agent in an aqueous medium to obtain aggregated particles (1); mixing the aggregated particles (1) with polyester-containing resin particles serving as a shell to obtain aggregated particles (2); and coalescing particles constituting the aggregated particles (2) to obtain core-shell particles. In Patent Literature 2, it is described that the toner obtained by the production process is excellent low-temperature fusing property and heat-resistant storage stability.

Patent Literature 1: JP 2010-169702A

Patent Literature 2: JP 2012-128024A

SUMMARY OF THE INVENTION

That is, the present invention relates to the following aspects [1] to [3].

[1] A process for producing a toner for development of electrostatic images, including the following steps (1) to (3):

step (1): mixing and emulsifying a releasing agent and a dispersion of resin particles (A) containing a polyester in an amount of not less than 90% by mass on the basis of a resin component in the resin particles (A) to obtain a dispersion of releasing agent particles;

step (2): mixing and aggregating the dispersion of the releasing agent particles obtained in the step (1) and a dispersion of resin particles (B) containing a polyester in an amount of not less than 90% by mass on the basis of a resin component in the resin particles (B) to obtain aggregated particles; and step (3): coalescing the aggregated particles obtained in the step (2) to obtain coalesced particles, in which an acid component constituting the polyester in the resin particles (A) contains an aliphatic carboxylic acid; the resin particles (A) have a volume median particle size of not less than 0.02 μm and not more than 0.50 μm; and a content of a surfactant in the dispersion of the releasing agent particles is not more than 0.5 part by mass on the basis of 100 parts by mass of the releasing agent.

[2] A process for producing a dispersion of releasing agent particles, including the following step (1):

step (1): mixing and emulsifying a releasing agent and a dispersion of resin particles (A) containing a polyester in an amount of not less than 90% by mass on the basis of a resin component in the resin particles (A) to obtain the dispersion of the releasing agent particles, in which an acid component constituting the polyester in the resin particles (A) contains an aliphatic carboxylic acid; the resin particles (A) have a volume median particle size of not less than 0.02 μm and not more than 0.50 μm; and a content of a surfactant in the dispersion of the releasing agent particles is not more than 0.5 part by mass on the basis of 100 parts by mass of the releasing agent.

[3] A kit for producing a dispersion of releasing agent particles which contains a surfactant in an amount of not more than 0.5 part by mass on the basis of 100 parts by mass of the releasing agent, the kit including the releasing agent, and a dispersion of resin particles (A) containing a polyester in an amount of not less than 90% by mass on the basis of a resin component in the resin particles (A), in which an acid component constituting the polyester in the resin particles (A) contains an aliphatic carboxylic acid; and the resin particles (A) have a volume median particle size of not less than 0.02 μm and not more than 0.50 μm.

DETAILED DESCRIPTION OF THE INVENTION

Upon producing a toner by a chemical method, there tends to occur such a problem that a releasing agent is insufficient in dispersibility in the toner because the chemical method includes no kneading step unlike the melt-kneading-pulverization method. For this reason, in the chemical method, a surfactant is used to disperse the releasing agent in an aqueous medium. However, when using the surfactant together with the releasing agent, although the releasing agent is improved in dispersion stability, there tends to arise such a problem that in the step subsequent to the aggregating step in which the releasing agent is aggregated together with resin particles in the aqueous medium, in particular, in the coalescing step, the releasing agent is desorbed from the resulting toner particles, or the releasing agent is exposed to a surface of the respective toner particles. Therefore, in the chemical method, the resulting toner tends to hardly exhibit a sufficient fusing property and suffer from deposition thereof on a developing device, etc., and therefore tends to be deteriorated in durability.

The present invention aims at providing a process for producing a toner for development of electrostatic images which is capable of suppressing desorption and exposure of a releasing agent therein, and excellent in fusing property, suppression of toner cloud and durability; a process for producing a dispersion; and a kit for producing the dispersion.

The present inventors have found that by using resin particles containing a polyester upon dispersing the releasing agent in the aqueous medium, it is possible to produce a dispersion of releasing agent particles without particularly using a dispersant such as a surfactant. Further, the present inventors have found that when producing a toner by the chemical method in which resin particles prepared from a resin having a composition close to that of the polyester are aggregated using the dispersion of the releasing agent particles, it is possible to suppress desorption of the releasing agent from the toner particles in the toner production step as well as exposure of the releasing agent onto a surface of the resulting toner.

That is, the present invention relates to the following aspects [1] to [3].

[1] A process for producing a toner for development of electrostatic images, including the following steps (1) to (3):

step (1); mixing and emulsifying a releasing agent and a dispersion of resin particles (A) containing a polyester in an amount of not less than 90% by mass on the basis of a resin component in the resin particles (A) to obtain a dispersion of releasing agent particles;

step (2): mixing and aggregating the dispersion of the releasing agent particles obtained in the step (1) and a dispersion of resin particles (B) containing a polyester in an amount of not less than 90% by mass on the basis of a resin component in the resin particles (B) to obtain aggregated particles; and step (3): coalescing the aggregated particles obtained in the step (2) to obtain coalesced particles, in which an acid component constituting the polyester in the resin particles (A) contains an aliphatic carboxylic acid; the resin particles (A) have a volume median particle size of not less than 0.02 μm and not more than 0.50 μm; and a content of a surfactant in the dispersion of the releasing agent particles is not more than 0.5 part by mass on the basis of 100 parts by mass of the releasing agent.

[2] A process for producing a dispersion of releasing agent particles, including the following step (1):

step (1): mixing and emulsifying a releasing agent and a dispersion of resin particles (A) containing a polyester in an amount of not less than 90% by mass on the basis of a resin component in the resin particles (A) to obtain the dispersion of the releasing agent particles, in which an acid component constituting the polyester in the resin particles (A) contains an aliphatic carboxylic acid; the resin particles (A) have a volume median particle size of not less than 0.02 μm and not more than 0.50 μm; and a content of a surfactant in the dispersion of the releasing agent particles is not more than 0.5 part by mass on the basis of 100 parts by mass of the releasing agent.

[3] A kit for producing a dispersion of releasing agent particles which contains a surfactant in an amount of not more than 0.5 part by mass on the basis of 100 parts by mass of the releasing agent, the kit including the releasing agent, and a dispersion of resin particles (A) containing a polyester in an amount of not less than 90% by mass on the basis of a resin component in the resin particles (A), in which an acid component constituting the polyester in the resin particles (A) contains an aliphatic carboxylic acid; and the resin particles (A) have a volume median particle size of not less than 0.02 μm and not more than 0.50 μm.

In accordance with the present invention, there are provided a process for producing a toner for development of electrostatic images which is capable of suppressing desorption and exposure of a releasing agent therein, and excellent in fusing property, suppression of toner cloud and durability; a process for producing a dispersion; and a kit for producing the dispersion.

[Process for Producing Toner]

The process for producing a toner according to the present invention includes the following steps (1) to (3):

step (1): mixing and emulsifying a releasing agent and a dispersion of resin particles (A) containing a polyester in an amount of not less than 90% by mass on the basis of a resin component in the resin particles (A) to obtain a dispersion of releasing agent particles;

step (2): mixing and aggregating the dispersion of the releasing agent particles obtained in the step (1) and a dispersion of resin particles (B) containing a polyester in an amount of not less than 90% by mass on the basis of a resin component in the resin particles (B) to obtain aggregated particles; and step (3): coalescing the aggregated particles obtained in the step (2) to obtain coalesced particles.

Incidentally, in the process for producing a toner according to the present invention, an acid component constituting the polyester in the resin particles (A) contains an aliphatic carboxylic acid; the resin particles (A) have a volume median particle size of not less than 0.02 μm and not more than 0.50 μm; and a content of a surfactant in the dispersion of the releasing agent particles is not more than 0.5 part by mass on the basis of 100 parts by mass of the releasing agent.

In addition, the step (2) may also include the following steps (2A) and (2B):

step (2A): mixing the dispersion of the releasing agent particles obtained in the step (1), the dispersion of the resin particles (B) and an aggregating agent with each other in an aqueous medium to obtain aggregated particles (1); and step (2B): adding the resin particles (B) to the aggregated particles (1) obtained in the step (2A) at one time or plural times in a split addition manner to obtain aggregated particles (2) onto which the resin particles (B) are adhered.

Meanwhile, in the case where the step (2A) and the step (2B) both are carried out, the "aggregated particles obtained in the step (2)" as described in the step (3) mean the "aggregated particles (2) obtained in the step (2B)". On the other hand, in the case where the step (2A) is carried out but no step (2B) is carried out, the "aggregated particles obtained in the step (2)" as described in the step (3) mean the "aggregated particles (1) obtained in the step (2A)".

The detailed mechanism of obtaining the toner that is excellent in fusing property, suppression of toner cloud and durability by the production process of the present invention is considered as follows, though it is not clearly determined yet.

As described above, when producing a toner by a chemical method, if a surfactant is used upon dispersing a releasing agent in an aqueous medium, the releasing agent tends to be desorbed from the obtained aggregated particles as a base material of the toner, in particular, upon coalescence of the particles, or the releasing agent tends to be exposed to a surface of the respective toner particles, owing to a high dispersion force of the surfactant. In order to avoid these problems, it is desired to disperse the releasing agent in the medium without using the surfactant, if possible. In the present invention, the releasing agent particles are dispersed in the medium using the resin particles. It is considered that by selectively using resin particles having an adequate polarity, the resin particles are well adsorbed onto the releasing agent as if they are a surfactant and therefore can be used in place of the surfactant, so that the releasing agent can be well dispersed in the medium. Further, it is considered that if the resin component constituting the resin particles used for dispersing the releasing agent (hereinafter referred to as resin particles (A)) is similar to the resin component constituting the resin particles forming a resin binder as a base material of the toner (hereinafter referred to as resin particles (B)), the releasing agent particles tend to be incorporated into aggregates of the resin particles (B) by stirring and mixing in the aggregating step, and further the resin particles (A) and the resin particles (B) tend to be integrated together in the coalescing step, so that desorption of the releasing agent from the toner as well as deterioration in performance of the toner owing to poor compatibility between the resins can be suppressed.

As described hereinlater, in the present invention, from the viewpoint of enhancing low-temperature fusing property and durability of the toner, the resin particles (B) forming a resin binder as a base material of the toner contains a polyester in an amount of not less than 90% by mass on the basis of a resin component in the resin particles (B). In consequence, in the step (1), by preparing the releasing agent particles from the releasing agent and the resin particles (A) containing a polyester in an amount of not less than 90% by mass on the basis of a resin component in the resin particles (A) and having a volume median particle size that lies within a specific range, it is possible to well disperse the releasing agent in the medium without particularly using a surfactant owing to an adequate polarity of the polyester. In addition, it is considered that since the releasing agent particles obtained in the step (1) are enhanced in affinity to the resin particles (B), the releasing agent tends to be hardly desorbed even after aggregating the releasing agent particles with the resin particles in the step (2), so that the resulting toner is further improved in fusing property and durability. Further, it is considered that since exposure of the releasing agent onto a surface of the toner is suppressed, occurrence of toner cloud in an electrophotographic device can be improved.

Furthermore, the acid component constituting the polyester contained in the resin particles (A) contains an aliphatic carboxylic acid component. It is considered that by incorporating the aliphatic carboxylic acid component into the constituents of the polyester, the polyester chain can be improved in flexibility, so that the resulting resin particles (A) can exhibit a volume median particle size capable of dispersing the releasing agent in the medium.

<Step (1)>

In the step (1) of the process for producing a toner according to the present invention, the releasing agent is mixed and emulsified with the dispersion of the resin particles (A) containing the polyester in an amount of not less than 90% by mass on the basis of a resin component in the resin particles (A) to thereby obtain a dispersion of releasing agent particles.

[Releasing Agent Particles]

(Releasing Agent)

Examples of the releasing agent include low-molecular weight polyolefins such as polyethylene, polypropylene and polybutene; silicone waxes; fatty acid amides such as oleamide and stearamide; vegetable waxes; animal waxes such as beeswax; mineral or petroleum waxes; and synthetic waxes such as ester waxes.

Specific examples of the vegetable waxes include a carnauba wax, a rice wax and a candelilla wax. Of these vegetable waxes, the carnauba wax is preferred from the viewpoint of improving releasing property and low-temperature fusing property of the resulting toner.

Specific examples of the mineral or petroleum waxes include a montan wax, a paraffin wax and a Fischer-Tropsch wax. Of these mineral or petroleum waxes, the paraffin wax is preferred from the viewpoint of improving releasing property and low-temperature fusing property of the resulting toner.

These releasing agents may be used alone or in combination of any two or more thereof, and are preferably used in combination of any two or more thereof. From the viewpoints of improving releasing property and low-temperature fusing property of the resulting toner and widening a temperature range in which the toner can be fused, it is preferable to use the vegetable wax in combination with the mineral or petroleum wax, and it is more preferable to use the carnauba wax in combination with the paraffin wax.

The melting point of the releasing agent is preferably not lower than 60° C., more preferably not lower than 65° C., and even more preferably not lower than 70° C., from the viewpoints of improving releasing property and durability of the resulting toner, widening a temperature range in which the toner can be fused and suppressing occurrence of toner cloud, and is also preferably not higher than 100° C., more preferably not higher than 95° C., even more preferably not higher than 90° C., and further even more preferably not higher than 85° C., from the viewpoints of improving low-temperature fusing property of the resulting toner and widening a temperature range in which the toner can be fused. When using two or more kinds of releasing agents in combination with each other, the melting points of these releasing agents all are in the range of not lower than 60° C. and not higher than 100° C., from the viewpoint of improving low-temperature fusing property of the resulting toner. More specifically, it is preferable to use at least two kinds of releasing agents each having a melting point of not lower than 60° C. and not higher than 100° C., and it is more preferable to use at least two kinds of releasing agents each having a melting point of not lower than 60° C. and not higher than 90° C.

In the present invention, the melting point of the releasing agent may be determined by the method described in Examples below. When using two or more kinds of releasing agents in combination with each other, the melting point of the releasing agent as defined in the present invention means a melting point of the releasing agent having a largest mass ratio among the releasing agents contained in the resulting toner. Meanwhile, if all of the releasing agents have the same mass ratio, the lowest melting point among those of the releasing agents is regarded as the melting point of the releasing agent as defined in the present invention.

The amount of the releasing agent used is preferably not less than 1 part by mass, more preferably not less than 2 parts by mass, and even more preferably not less than 5 parts by mass, on the basis of 100 parts by mass of the resins in the toner, from the viewpoints of improving releasing property and low-temperature fusing property of the resulting toner and widening a temperature range in which the toner can be fused, and is also preferably not more than 20 parts by mass, and more preferably not more than 15 parts by mass, on the basis of 100 parts by mass of the resins in the toner, from the viewpoint of improving durability of the resulting toner.

(Resin Particles (A))

The resin particles (A) have a function as a dispersant for the releasing agent.

The present invention is characterized in that the releasing agent particles contain the resin particles (A). It is considered that since the releasing agent is dispersed in the medium through the resin particles having an adequate polarity, the resin particles are well absorbed onto the releasing agent, so that a stable dispersion can be obtained without adding a surfactant thereto, and the releasing agent particles tend to be incorporated into aggregates of the resin (binder) particles by stirring and mixing in the aggregating step, or the releasing agent particles thus incorporated tend to be hardly separated from the obtained aggregated particles.

The resin particles (A) used in the present invention contain the polyester in an amount of not less than 90% by mass on the basis of a resin component in the resin particles (A), from the viewpoint of improving dispersion stability of the releasing agent particles as well as low-temperature fusing property and durability of the resulting toner.

The content of the polyester in the resin component constituting the resin particles (A) is preferably not less than 95% by mass, more preferably not less than 98% by mass, even more preferably substantially 100% by mass, and further even more preferably 100% by mass, and is also not more than 100% by mass, from the same viewpoint as described above.

As the resin component constituting the resin particles (A), in addition to the polyester, there may be used conventionally known resins that are usable in toners, for example, styrene-acrylic copolymers, epoxy resins, polycarbonates, polyurethanes, etc.

The raw material monomers constituting the polyester contained in the resin particles (A) are an alcohol component and an acid component. The alcohol component and acid component used may be an arbitrary alcohol component and an arbitrary acid component, respectively.

From the viewpoints of improving dispersion stability of the releasing agent particles as well as low-temperature fusing property of the resulting toner, and widening a temperature range in which the toner can be fused, the acid component constituting the polyester contained in the resin particles (A) contains an aliphatic carboxylic acid.

In the present invention, the aliphatic carboxylic acid component generally means an aliphatic dicarboxylic acid, a trivalent or higher-valent aliphatic polycarboxylic acid, and an anhydride and an alkyl (having not less than 1 and not more than 3 carbon atoms) ester thereof among the carboxylic acid components of the polyester. When incorporating the aliphatic carboxylic acid component in the constituents of the polyester, the polyester chain can be improved in flexibility, so that the obtained resin particles (A) have a volume median particle size capable of well dispersing the releasing agent in the medium. Examples of the aliphatic dicarboxylic acid include sebacic acid, fumaric acid, maleic acid, adipic acid, succinic acid, cyclohexanedicarboxylic acid, and succinic acids substituted with an alkyl group having not less than 1 and not more than 20 carbon atoms or an alkenyl group having not less than 2 and not more than 20 carbon atoms. Specific examples of the succinic acids substituted with an alkyl group having not less than 1 and not more than 20 carbon atoms or an alkenyl group having not less than 2 and not more than 20 carbon atoms include dodecylsuccinic acid, dodecenylsuccinic acid and octenylsuccinic acid. Specific examples of the trivalent or higher-valent aliphatic polycarboxylic acid include butane-1,2,4-tricarboxylic acid, 1,3,6-hexanetricarboxylic acid and cyclohexane-1,2,3-tricarboxylic acid.

Of these acids, preferred is at least one acid selected from the group consisting of fumaric acid, adipic acid, succinic acid, succinic acids substituted with an alkenyl group having not less than 2 and not more than 20 carbon atoms, and anhydrides of these acids, more preferred is at least one acid selected from the group consisting of fumaric acid, adipic acid, succinic acid and succinic acids substituted with an alkenyl group having not less than 2 and not more than 20 carbon atoms, and even more preferred is fumaric acid.

Examples of the carboxylic acid component other than the aliphatic carboxylic acid used as the raw material monomer constituting the polyester contained in the resin particles (A) include dicarboxylic acids and trivalent or higher-valent polycarboxylic acids other than the aliphatic carboxylic acids, and anhydrides and alkyl (having not less than 1 and not more than 3 carbon atoms) esters thereof. Of these acids, preferred are the dicarboxylic acids other than the aliphatic carboxylic acids.

Specific examples of the dicarboxylic acids other than the aliphatic carboxylic acids include aromatic dicarboxylic acids. Examples of the aromatic dicarboxylic acids include phthalic acid, isophthalic acid and terephthalic acid. Of these dicarboxylic acids, from the viewpoint of improving durability and charging property of the resulting toner, preferred are the aromatic dicarboxylic acids, and more preferred is terephthalic acid.

Examples of the trivalent or higher-valent polycarboxylic acids other than the aliphatic carboxylic acids include aromatic polycarboxylic acids. Specific examples of the trivalent or higher-valent aromatic polycarboxylic acids include trimellitic acid, 2,5,7-naphthalene-tricarboxylic acid and pyromellitic acid. Of these acids, from the viewpoint of improving low-temperature fusing property and durability of the resulting toner, preferred are trimellitic acid and trimellitic anhydride, and more preferred is trimellitic anhydride.

These carboxylic acid components may be used alone or in combination of any two or more thereof.

The content $S_A$ of the aliphatic carboxylic acid component in the acid component constituting the polyester contained in the resin particles (A) is preferably not less than 1% by mass, more preferably not less than 3% by mass, even more preferably not less than 10% by mass, further even more preferably not less than 20% by mass, and further even more preferably not less than 25% by mass, from the viewpoints of improving dispersion stability of the releasing agent particles as well as durability of the resulting toner, widening a temperature range in which the toner can be fused, and suppressing occurrence of toner cloud, and is also preferably not more than 100% by mass, more preferably not more than 90% by mass, even more preferably not more than 80% by mass, further even more preferably not more than 70% by mass, further even more preferably not more than 55% by mass, and further even more preferably not more than 48% by mass, from the viewpoints of improving low-temperature fusing property and durability of the resulting toner, widening a temperature range in which the toner can be fused, and suppressing occurrence of toner cloud.

In addition, examples of the alcohol component include aliphatic diols having not less than 2 and not more than 12 main-chain carbon atoms, aromatic diols, alicyclic diols, trivalent or higher-valent polyhydric alcohols, and alkylene (having not less than 2 and not more than 4 carbon atoms) oxide adducts (average molar number of addition of alkyleneoxide: not less than 1 and not more than 16) of these alcohol components.

Specific examples of the preferred alcohol component include alkylene (having not less than 2 and not more than 3 carbon atoms) oxide adducts (average molar number of addition of alkyleneoxide: not less than 1 and not more than 16) of bisphenol A such as polyoxypropylene-2,2-bis(4-hydroxyphenyl)propane and polyoxyethylene-2,2-bis(4-hydroxyphenyl)propane; alicyclic diols such as hydrogenated products of bisphenol A, and alkylene (having not less than 2 and not more than 4 carbon atoms) oxide adducts (average molar number of addition of alkyleneoxide: not less than 1 and not more than 16) thereof; aliphatic diols having not less than 2 and not more than 12 main-chain carbon atoms such as ethylene glycol, propylene glycol, neopentyl glycol, 1,4-butanediol, 1,3-butanediol and 1,6-hexanediol, and alkylene (having not less than 2 and not more than 4 carbon atoms) oxide adducts (average molar number of addition of alkyleneoxide: not less than 1 and not more than 16) thereof; and trivalent or higher-valent polyhydric alcohols such as glycerol, pentaerythritol, trimethylol propane and sorbitol, and alkylene (having not less than 2 and not more than 4 carbon atoms) oxide adducts (average molar number of addition of alkyleneoxide: not less than 1 and not more than 16) thereof. These alcohol components may be used in combination of any two or more thereof. Of these alcohol components, from the viewpoint of improving durability of the resulting toner, preferred are those alcohol components containing aromatic diols, and more preferred are alkylene (having not less than 2 and not more than 3 carbon atoms) oxide adducts (average molar number of addition of alkyleneoxide: not less than 1 and not more than 16) of bisphenol A such as polyoxypropylene-2,2-bis(4-hydroxyphenyl)propane and polyoxyethylene-2,2-bis(4-hydroxyphenyl)propane.

The polyester may be produced by subjecting the aforementioned alcohol component and carboxylic acid component to polycondensation reaction in an inert gas atmosphere at a temperature of not lower than 180° C. and not higher than 250° C., if required, in the presence of an esterification catalyst, a polymerization inhibitor, etc.

Examples of the esterification catalyst used in the polycondensation reaction include tin compounds such as dibutyl tin oxide and tin di(2-ethyl hexanoate), and titanium compounds such as titanium diisopropylate bistriethanol aminate. The amount of the esterification catalyst used in the polycondensation reaction is preferably not less than 0.01 part by mass, and more preferably not less than 0.1 part by mass, and is also preferably not more than 1 part by mass, and more preferably not more than 0.8 part by mass, on the basis of 100 parts by mass of a total amount of the alcohol component and the carboxylic acid component.

Examples of the polymerization inhibitor include tert-butyl catechol, etc. The amount of the polymerization inhibitor used in the polycondensation reaction is preferably not less than 0.001 part by mass, and more preferably not less than 0.005 part by mass, and is also preferably not more than 0.5 part by mass, and more preferably not more than 0.1 part by mass, on the basis of 100 parts by mass of a total amount of the alcohol component and the carboxylic acid component.

The softening point of the polyester is preferably not lower than 70° C., more preferably not lower than 90° C., and even more preferably not lower than 100° C., and is also preferably not higher than 165° C., more preferably not higher than 140° C., even more preferably not higher than 130° C., and further even more preferably not higher than 125° C., from the viewpoints of widening a temperature range in which the toner can be fused and improving low-temperature fusing property and durability of the resulting toner.

The glass transition temperature of the polyester is preferably not lower than 50° C., more preferably not lower than 53° C., and even more preferably not lower than 55° C., and is also preferably not higher than 85° C., more preferably not higher than 80° C., and even more preferably not higher than 70° C., from the viewpoints of widening a temperature range in which the toner can be fused and improving low-temperature fusing property and durability of the resulting toner.

The acid value of the polyester is preferably not less than 6 mgKOH/g, more preferably not less than 10 mgKOH/g, even more preferably not less than 15 mgKOH/g, and further even more preferably not less than 20 mgKOH/g, and is also preferably not more than 35 mgKOH/g, more preferably not more than 30 mgKOH/g, and even more preferably not more than 25 mgKOH/g, from the viewpoints of improving dispersion stability of the dispersion of the resin particles as well as durability of the resulting toner, and widening a temperature range in which the toner can be fused.

The softening point, glass transition temperature and acid value of the polyester may be respectively adjusted to desired values by suitably controlling the kinds and charging ratios of the alcohol component and carboxylic acid component, and the temperature and time of the polycondensation reaction.

Meanwhile, in the present invention, the polyester includes not only an unmodified polyester, but also a modified polyester obtained by modifying a polyester to such an extent that substantially no adverse influence is exerted on properties of the polyester. As the modified polyester, there may be mentioned those grafted or blocked polyesters obtained by grafting or blocking the polyester with phenol, urethane, epoxy, etc., by the methods described, for example, in JP 11-133668A, JP 10-239903A and JP 8-20636A, and composite resins containing two or more kinds of resin units including a polyester unit, etc.

In addition, in the case where the resin particles contain a plurality of resins, the softening point, glass transition temperature and acid value of the resin component constituting the aforementioned resin particles respectively mean the softening point, glass transition temperature and acid value of a mixture of the resins, and the respective characteristic values preferably fall within corresponding characteristic values of the polyester. The softening point, glass transition temperature and acid value of the mixture of the resins may be determined as a weighted average value of the respective characteristic values, i.e., determined from a sum of products of the characteristic value and content ratio of the respective resins The resin component constituting the resin particles (A) may contain two kinds of polyesters which are different in softening point from each other. From the viewpoints of widening a temperature range in which the toner can be fused and improving low-temperature fusing property and durability of the resulting toner, the softening point of one polyester (I) is preferably not lower than 70° C. and lower than 115° C., whereas the softening point of the other polyester (II) is preferably not lower than 115° C. and not higher than 165° C. From the same viewpoints as described above, the difference between softening points of the two kinds of polyester resins is preferably not less than 5° C., and more preferably not less than 10° C., and is also preferably not more than 30° C., and more preferably not more than 20° C. The mass ratio of the polyester (I) to the polyester (II) [(I)/(II)] is preferably from 10/90 to 90/10 and more preferably from 50/50 to 90/10, from the viewpoints of widening a temperature range in which the toner can be fused and improving low-temperature fusing property and durability of the resulting toner.

The resin particles (A) may also contain a colorant, a releasing agent and a charge control agent unless the effects of the present invention are adversely influenced. Further, the resin particles (A) may also contain other additives such as a reinforcing filler such as fibrous substances, an antioxidant and an anti-aging agent, if required.

(Production of Resin Particles (A))

The resin particles (A) are preferably produced by the method of mixing the resins containing the polyester with a surfactant and the aforementioned optional components in an aqueous medium to obtain a dispersion of the resin particles (A).

The aqueous medium used in the present invention preferably contains water as a main component. From the viewpoints of attaining a good environmental suitability and improving dispersion stability of the releasing agent particles, the content of water in the aqueous medium is preferably not less than 80% by mass, more preferably not less than 90% by mass, even more preferably not less than 95% by mass, further even more preferably substantially 100% by mass, and further even more preferably 100% by mass, and is also not more than 100% by mass. As the water, deionized water or distilled water is preferably used.

Examples of components other than water which may be contained in the aqueous medium include water-soluble organic solvents, e.g., alkyl alcohols having not less than 1 and not more than 5 carbon atoms, such as methanol, ethanol, isopropanol and butanol; chalky' ketones having not less than 3 and not more than 4 carbon atoms, such as acetone and methyl ethyl ketone; and cyclic ethers such as tetrahydrofuran. Of these organic solvents, from the viewpoint of preventing inclusion of the organic solvents into the toner, preferred are alcohols having not less than 1 and not more than 5 carbon atoms such as methanol, ethanol, isopropanol and butanol, which are organic solvents incapable of dissolving the resin component therein.

In the present invention, upon producing the dispersion of the resin particles (A), from the viewpoints of improving dispersion stability of the releasing agent particles by efficiently utilizing a good dispersion stabilization effect given by the resin particles (A), obtaining uniform aggregated particles in the subsequent aggregating step, and suppressing desorption of the releasing agent from the aggregated particles, it is preferred to avoid the conditions using a surfactant. However, from the viewpoint of improving dispersion stability of the dispersion of the resin particles, the surfactant may also be used unless the effects of the present invention are adversely affected.

Examples of the surfactant include a nonionic surfactant, an anionic surfactant and a cationic surfactant. Of these surfactants, preferred is a nonionic surfactant. The nonionic surfactant is preferably used in combination with the anionic surfactant or the cationic surfactant. From the viewpoint of improving dispersion stability of the dispersion of the resin particles, the nonionic surfactant is more preferably used in combination with the anionic surfactant.

When using the nonionic surfactant in combination with the anionic surfactant, the mass ratio of the nonionic surfactant to the anionic surfactant (nonionic surfactant/anionic surfactant) is preferably not less than 0.3, and more preferably not less than 0.5, and is also preferably not more than 10, more preferably not more than 5, and even more preferably not more than 2, from the viewpoint of improving dispersion stability of the dispersion of the resin particles.

Examples of the nonionic surfactant include polyoxyethylene alkyl or alkenyl ethers, polyoxyethylene alkyl aryl ethers, polyoxyethylene fatty acid esters and oxyethylene/oxypropylene block copolymers.

Specific examples of the polyoxyethylene alkyl or alkenyl ethers include polyoxyethylene oleyl ether and polyoxyethylene lauryl ether.

Specific examples of the polyoxyethylene alkyl aryl ethers include polyoxyethylene nonyl phenyl ether.

Specific examples of the polyoxyethylene fatty acid esters include polyethylene glycol monolaurate, polyethylene glycol monostearate and polyethylene glycol monooleate.

Of these nonionic surfactants, from the viewpoint of improving dispersion stability of the dispersion of the resin particles, preferred are the polyoxyethylene alkyl or alkenyl ethers, and more preferred is polyoxyethylene oleyl ether.

Examples of the anionic surfactant include alkylbenzenesulfonic acid salts, alkylsulfuric acid salts and alkylethersulfuric acid salts. Of these anionic surfactants, preferred are alkylbenzenesulfonic acid salts and alkylethersulfuric acid salts, from the viewpoint of improving dispersion stability of the dispersion of the resin particles.

As the alkylbenzenesulfonic acid salts, preferred are alkylbenzenesulfonic acid alkali metal salts, and more preferred are sodium alkylbenzenesulfonates. As the alkyl group in the alkylbenzenesulfonic acid salts, a dodecyl group is preferred. As the alkylbenzenesulfonic acid salts, preferred are dodecylbenzenesulfonic acid salts, more preferred are dodecylbenzenesulfonic acid alkali metal salts, and even more preferred is sodium dodecylbenzenesulfonate.

As the alkylsulfuric acid salts, preferred are alkylsulfuric acid alkali metal salts, and more preferred are sodium alkylsulfates. As the alkyl group in the alkylsulfuric acid salts, a dodecyl group is preferred. As the alkylsulfuric acid salts, preferred are dodecylsulfuric acid alkali metal salts, and more preferred is sodium dodecylsulfate.

As the alkylethersulfuric acid salts, preferred are alkylethersulfuric acid alkali metal salts, and more preferred are sodium alkylethersulfates. As the alkyl group in the alkylethersulfuric acid salts, a dodecyl group is preferred. As the alkylethersulfuric acid salts, preferred are dodecylethersulfuric acid salts, more preferred are dodecylethersulfuric acid alkali metal salts, and even more preferred is sodium dodecylethersulfate.

The cationic surfactant is preferably in the form of a quaternary ammonium salt. Specific examples of the cationic surfactant include alkylbenzenedimethyl ammonium chlorides, alkyltrimethyl ammonium chlorides and the like.

The amount of the surfactant used is preferably as small as possible, from the viewpoint of suppressing desorption of the releasing agent from the aggregated particles as described above. However, from the viewpoint of improving dispersion stability of the dispersion of the resin particles, the amount of the surfactant used is preferably not less than 0.1 part by mass, more preferably not less than 0.5 part by mass, and even more preferably not less than 1 part by mass, on the basis of 100 parts by mass of the resin component constituting the resin particles (A). Also, from the viewpoint of improving storage stability of the resulting toner, the amount of the surfactant used is preferably not more than 20 parts by mass, more preferably not more than 15 parts by mass, even more preferably not more than 10 parts by mass, and further even more preferably not more than 5 parts by mass, on the basis of 100 parts by mass of the resin component constituting the resin particles (A).

As the method of obtaining the dispersion containing the resin particles (A), there may be used a method of adding the resins and the like to the aqueous medium and subjecting the resulting mixture to dispersing treatment using a disperser, a phase inversion emulsification method in which the aqueous medium is gradually added to the resins and the like to emulsify the mixture, etc. Of these methods, from the viewpoint of widening a temperature range in which the toner can be fused, the phase inversion emulsification method is preferred. In the following, the phase inversion emulsification method is explained.

First, the resin component containing the polyester, the surfactant and the aforementioned optional components such as a colorant are melted and mixed with each other to obtain a resin mixture.

In the case where the resin component containing the polyester includes a plurality of resins, a mixed resin prepared by previously mixing the resins with each other may be used. Alternatively, the plurality of resins may be added simultaneously upon addition of the other components and then melted and mixed together to obtain the resin mixture.

As the method of producing the resin mixture, there is preferably used a method in which the resin component containing the polyester, the surfactant, the aforementioned optional components such as a colorant, and an alkali aqueous solution are charged into a vessel, and while stirring the contents of the vessel using a stirrer, the resin component is melted and uniformly mixed with the other components to prepare the resin mixture.

Examples of the alkali contained in the alkali aqueous solution include hydroxides of alkali metals such as potassium hydroxide and sodium hydroxide, and ammonia. From the viewpoint of improving emulsification stability of the resin component, of these alkalis, preferred are potassium hydroxide and sodium hydroxide. The concentration of the alkali in the alkali aqueous solution is preferably not less than 1% by mass, more preferably not less than 2% by mass, and even more preferably not less than 3% by mass, and is also preferably not more than 10% by mass, more preferably not more than 8% by mass, and even more preferably not more than 7% by mass.

The temperature used upon melting and mixing the resin component is preferably not lower than a glass transition temperature of the resin component and not higher than a boiling point of the aqueous medium, from the viewpoint of obtaining uniform resin particles. More specifically, the temperature used upon melting and mixing the resin component is preferably not lower than 70° C., more preferably not lower than 80° C., and even more preferably not lower than 90° C., and is also preferably not higher than 100° C., and more preferably not higher than 98° C.

Next, the aqueous medium is added to the above resin mixture to subject the resin mixture to phase inversion, thereby obtaining a dispersion containing the resin particles (A).

The temperature used upon adding the aqueous medium is preferably not lower than a glass transition temperature of the resin component and not higher than a boiling point of the aqueous medium, from the viewpoint of obtaining uniform resin particles. More specifically, the temperature used upon adding the aqueous medium is preferably not lower than 70° C., more preferably not lower than 80° C., and even more preferably not lower than 90° C., and is also preferably not higher than 100° C., and more preferably not higher than 98° C.

From the viewpoint of reducing a particle size of the resin particles, the velocity of addition of the aqueous medium until terminating the phase inversion is preferably not less than 0.1 part by mass/min, and more preferably not less than 0.5 part by mass/min, and is also preferably not more than 50 parts by mass/min, more preferably not more than 30 parts by mass/min, even preferably not more than 10 parts by mass/min, and further even more preferably not more than 5 parts by mass/min, on the basis of 100 parts by mass of the resin component constituting the resin particles (A). However, the velocity of addition of the aqueous medium after terminating the phase inversion is not particularly limited The amount of the aqueous medium used is preferably not less than 100 parts by mass, more preferably not less than 150 parts by mass, and even more preferably not less than 170 parts by mass, and is also preferably not more than 900 parts by mass, more preferably not more than 500 parts by mass, and even more preferably not more than 300 parts by mass, on the basis of 100 parts by mass of the resin component constituting the resin particles (A), from the viewpoints of enhancing productivity of the toner, and improving dispersion stability of the dispersion of the resin particles and the dispersion of the releasing agent particles.

The solid content of the resulting dispersion of the resin particles (A) is preferably not less than 10% by mass, more preferably not less than 15% by mass, and even more preferably not less than 20% by mass, and is also preferably not more than 50% by mass, more preferably not more than 40% by mass, and even preferably not more than 35% by mass, from the viewpoints of improving dispersion stability of the dispersion of the resin particles, facilitating handling of the dispersion of the resin particles, and enhancing productivity of the toner. Meanwhile, the solid content means the value based on non-volatile components including the resins, pigments, surfactants and the like.

The volume median particle size ($D_{50}$) of the resin particles (A) contained in the dispersion of the resin particles (A) is not less than 0.02 μm and not more than 0.50 μm, from the viewpoint of improving dispersion stability of the releasing agent particles. The volume median particle size ($D_{50}$) of the resin particles (A) is preferably not less than 0.05 μm, and more preferably not less than 0.10 μm, and is also preferably not more than 0.40 μm, more preferably not more than 0.30 μm, even more preferably not more than 0.20 μm, further even more preferably not more than 0.15 μm, and further even more preferably not more than 0.12 μm.

The volume median particle size ($D_{50}$) as used herein means a particle size at which a cumulative volume frequency calculated on the basis of a volume fraction of particles from a smaller particle size side thereof is 50%, and may be measured by the method as described in Examples below.

The coefficient of variation of particle size distribution (CV: %) of the resin particles (A) is preferably not more than 40%, more preferably not more than 35%, and even more preferably not more than 30%, from the viewpoint of improving dispersion stability of the releasing agent particles, and is also preferably not less than 5%, more preferably not less than 10%, and even more preferably not less than 15%, from the viewpoint of enhancing productivity of the dispersion of the resin particles (A). Meanwhile, the CV means the value represented by the following formula, and may be determined by the method as described in Examples below.

CV (%)=[Standard Deviation of Particle Size Distribution (μm)/Volume Average Particle Size (μm)]×100.

(Production of Releasing Agent Particles)

The releasing agent particles are preferably obtained in the form of a dispersion of the releasing agent particle which is prepared by dispersing the releasing agent in an aqueous medium.

In the step (1), by preparing the releasing agent particles from the releasing agent and the resin particles (A) containing the polyester in an amount of not less than 90% by mass on the basis of a resin component in the resin particles (A) and having a volume median particle size that falls within the specific range, it is possible to disperse the releasing agent in the aqueous medium without particularly using a surfactant, owing to an adequate polarity of the polyester.

The dispersion of the releasing agent particles is preferably obtained by dispersing the releasing agent and the aqueous medium in the presence of the resin particles (A) at a temperature not lower than a melting point of the releasing agent by using a disperser. As the disperser, from the viewpoints of widening a temperature range in which the toner can be fused and improving durability of the resulting toner, a homogenizer, a high-pressure disperser and an ultrasonic disperser, etc., are preferably used, and an ultrasonic disperser is more preferably used. The dispersing time may be appropriately determined according to the disperser used.

As the ultrasonic disperser, there may be used, for example, an ultrasonic homogenizer. Examples of the commercially available ultrasonic homogenizers include "US-150T", "US-300T" and "US-600T" (all available from Nihonseiki Kaisha Ltd.), and "SONIFIER 4020-400" and "SONIFIER 4020-800" (both available from Branson Ultrasonics, Emerson Japan, Ltd.).

Further, it is preferred that before using the above disperser, the releasing agent and the dispersion of the resin particles (A), if required, together with the aqueous medium, are previously dispersed using a mixing device such as a homomixer and a ball mill.

The preferred forms of the aqueous medium used in the above production process are the same as those used for production of the aforementioned resin particles (A).

From the viewpoints of improving dispersion stability of the releasing agent particles, obtaining uniform aggregated particles in the subsequent aggregating step, incorporating the releasing agent into the toner even after heating in the coalescing step, improving durability and low-temperature fusing property of the resulting toner, and suppressing occurrence of toner cloud, the mass ratio of the releasing agent to the resin particles (A) [releasing agent/resin particles (A)] in the releasing agent particles is preferably from 99/1 to 51/49, more preferably from 97/3 to 60/40, even more preferably from 95/5 to 70/30, and further even more preferably from 95/5 to 80/20.

From the viewpoints of widening a temperature range in which the toner can be fused and improving low-temperature fusing property and durability of the resulting toner, the releasing agent particles are preferably used in the form of a dispersion of the releasing agent particles which is prepared by mixing the releasing agent and the dispersion of the resin particles (A), if required, together with a dispersion-stabilizing aid such as an oxazoline group-containing compound, and then dispersing the resulting mixture.

From the viewpoints of improving dispersion stability of the releasing agent particles, obtaining uniform aggregated particles in the subsequent aggregating step, incorporating the releasing agent into the toner even after heating in the coalescing step, and improving durability and low-temperature fusing property of the resulting toner, it is preferred that not only the releasing agent and the dispersion of the resin particles (A) but also the dispersion-stabilizing aid are mixed with each other. By further mixing the dispersion-stabilizing aid in the dispersion, the releasing agent particles can be enhanced in dispersion stability and are likely to be incorporated into the resin component containing the polyester upon the aggregating step, so that the releasing agent can be more effectively prevented from suffering from desorption from the particles upon the coalescing step.

(Dispersion-Stabilizing Aid)

The dispersion-stabilizing aid used in the present invention is preferably a compound containing a functional group capable of reacting with both the releasing agent and the resin particles. In the case where the releasing agent includes a vegetable wax, the dispersion-stabilizing aid is preferably a compound containing a functional group capable of reacting with a carboxy group, and there may be used a compound containing a plurality of functional groups each capable of reacting with a carboxy group in a molecule thereof. The functional group capable of reacting with a carboxy group is preferably an oxazoline group, an epoxy group, an aziridine group or a carbodiimide group, from the viewpoint of allowing the functional group to react with a carboxy group in an aqueous medium. Of these functional groups, more preferred are an oxazoline group and an epoxy group, and even more preferred is an oxazoline group, from the viewpoint of improving a charging property of the resulting toner owing to an oxygen atom present in the functional group.

The dispersion-stabilizing aid used in the present invention is added to the dispersion prepared by dispersing the releasing agent particles in the aqueous medium, and is therefore preferably water-soluble from the viewpoint of high reactivity. The "water-soluble" as used herein means that the material can be dissolved in water without causing turbidity or precipitation. More specifically, the solubility of the dispersion-stabilizing aid in 100 g of water as measured at 25° C. is not less than 15 g, and preferably not less than 25 g.

The oxazoline group-containing compound is preferably a compound containing a plurality of oxazoline groups in a molecule thereof, and more preferably an oxazoline group-containing polymer. The number-average molecular weight of the oxazoline group-containing polymer is preferably not less than 500, and more preferably not less than 1,000, and is also preferably not more than 2,000,000, and more preferably not more than 1,000,000, from the viewpoint of enhancing reactivity with the releasing agent and the resins Examples of commercially available products of the oxazoline group-containing polymer include "EPOCROS WS Series" (water-soluble type; main chain: acrylic) available from Nippon Shokubai Co., Ltd., "K Series" (emulsion type; main chain: styrene/acrylic) available from Nippon Shokubai Co., Ltd., etc.

The epoxy group-containing compound is preferably a compound containing a plurality of epoxy groups in a molecule thereof, and more preferably a compound containing four or more epoxy groups in a molecule thereof from the viewpoint of enhancing reactivity with the releasing agent and the resins. Also, from the viewpoint of suppressing production of coarse particles, the epoxy group-containing compound is preferably a compound containing not more than 10 epoxy groups in a molecule thereof, more preferably a compound containing not more than 8 epoxy groups in a molecule thereof, and even more preferably a compound containing not more than 6 epoxy groups in a molecule thereof. The number-average molecular weight of the epoxy group-containing compound is preferably not less than 100, more preferably not less than 200, and even more preferably not less than 400, and is also preferably not more than 1,500, more preferably not more than 1,300, and even more preferably not more than 1,100, from the viewpoint of enhancing reactivity with the releasing agent and the resins The epoxy group-containing compound is not particularly limited as long as it contains 4 or more epoxy groups in a molecule thereof. Examples of the epoxy group-containing compound include glycerol-polyglycidyl ether, trimethylol propane-polyglycidyl ether, sorbitol-polyglycidyl ether and polyglycerol-polyglycidyl ether. Of these epoxy group-containing compounds, from the viewpoint of enhancing reactivity with the releasing agent and the resins, preferred is polyglycerol-polyglycidyl ether. Examples of commercially available products of the epoxy group-containing compound include "DENACOL Series" available from Nagase ChemteX Corporation, and "EPIOL Series" available from NOF Corporation.

The content of the dispersion-stabilizing aid in the dispersion or the amount of the dispersion-stabilizing aid added thereto is preferably not less than 0.2 part by mass, more preferably not less than 0.5 part by mass, and even more preferably not less than 0.7 part by mass, and is also preferably not more than 5 parts by mass, more preferably not more than 2 parts by mass, and even more preferably not more than 1 part by mass, in terms of solid components therein, on the basis of 100 parts by mass of the releasing agent, from the viewpoints of enhancing reactivity with the releasing agent and the resins as well as productivity of the releasing agent particles.

In the present invention, the procedure of dispersing the releasing agent particles in the aqueous medium is preferably carried out under the condition in which no surfactant is added thereto, or under the condition in which the content of the surfactant in the dispersion is not more than 0.5 part by mass on the basis of 100 parts by mass of the releasing agent, from the viewpoints of improving dispersion stability of the releasing agent particles by efficiently utilizing a good dispersion stabilization effect given by the resin particles (A), and obtaining uniform aggregated particles in the subsequent aggregating step.

Examples of the surfactant are the same as those illustrated above in the production of the resin particles (A). Other examples of the surfactant include high-molecular weight compounds which act as an anionic surfactant and contain a salt of a carboxy group in a side chain thereof, such as poly(sodium (meth)acrylate) and sodium (meth)acrylate-sodium maleate copolymers.

The content of the surfactant in the dispersion of the releasing agent particles, i.e., the content of the surfactant that is brought into the dispersion of the releasing agent particles by incorporating the surfactant into the dispersion of the resin particles (A) is not more than 0.5 part by mass, preferably not more than 0.3 part by mass, and more preferably not more than 0.2 part by mass, and is also not less than 0 part by mass, on the basis of 100 parts by mass of the releasing agent, from the viewpoints of improving releasing property of the resulting toner and widening a temperature range in which the toner can be fused. It is even more preferred that the dispersion of the releasing agent particles contains no surfactant.

In the step (1), the releasing agent and the resin particles (A) are preferably added to the aqueous medium, and the resulting mixture is dispersed while heating at a temperature not lower than a melting point of the releasing agent.

More specifically, the heating temperature upon dispersing the mixture is preferably a temperature not lower than a melting point of the releasing agent and not lower than 80° C., more preferably not lower than 85° C., and even more preferably not lower than 90° C., and is also preferably not higher than 100° C., more preferably not higher than 98° C., and even more preferably not higher than 95° C., from the viewpoint of enhancing productivity of the dispersion of the releasing agent particles.

Also, the heating time upon dispersing the mixture is preferably not less than 5 min, more preferably not less than 10 min, and even more preferably not less than 15 min, and is also preferably not more than 3 h, more preferably not more than 2 h, and even more preferably not more than 1 h, from the viewpoint of enhancing productivity of the dispersion of the releasing agent p articles.

The solid content of the dispersion of the releasing agent particles is preferably not less than 5% by mass, more preferably not less than 10% by mass, and even more preferably not less than 15% by mass, and is also preferably not more than 40% by mass, more preferably not more than 30% by mass, and even preferably not more than 25% by mass, from the viewpoints of improving dispersion stability of the releasing agent particles, facilitating handling of the dispersion of the releasing agent particles, and enhancing productivity of the toner.

The volume median particle size ($D_{50}$) of the releasing agent particles is preferably not less than 0.05 μm, more preferably not less than 0.20 μm, even more preferably not less than 0.40 μm, and further even more preferably not less than 0.50 μm, and is also preferably not more than 1.00 μm, more preferably not more than 0.80 μm, even more preferably not more than 0.70 Jim, further even more preferably not more than 0.65 μm, and further even more preferably not more than 0.60 μm, from the viewpoints of obtaining uniform aggregated particles in the subsequent aggregating step, and improving durability of the resulting toner.

The volume median particle size ($D_{50}$) of the releasing agent particles may be measured by the method as described in Examples below.

The coefficient of variation of particle size distribution (CV: %) of the releasing agent particles is preferably not more than 50%, more preferably not more than 40%, and even more preferably not more than 37%, from the viewpoints of obtaining uniform aggregated particles in the subsequent aggregating step, and improving durability of the resulting toner, and is also preferably not less than 15%, more preferably not less than 20%, and even more preferably not less than 25%, from the viewpoint of enhancing productivity of the dispersion of the releasing agent particles. Meanwhile, the particle size distribution of the releasing agent particles may be determined by the method as described in Examples below.

<Step (2)>

In the step (2), the dispersion of the releasing agent particles obtained in the step (1) is mixed and aggregated with a dispersion of resin particles (B) and, if required, an aggregating agent, to thereby obtain aggregated particles.

In addition, the step (2) may also include the following step (2A), and may further include the following step (2B) subsequent to the step (2A):

step (2A): mixing the dispersion of the releasing agent particles obtained in the step (1), the dispersion of the resin particles (B) and the aggregating agent with each other in an aqueous medium to obtain aggregated particles (1); and step (2B): adding the resin particles (B) to the aggregated particles (1) obtained in the step (2A) at one time or plural times in a split addition manner to obtain aggregated particles (2) in which the resin particles (B) are adhered onto the aggregated particles (resin particle (B)-deposited aggregated p articles).

Next, the respective components used in the step (2) as well as the step (2A) and the step (2B) are explained.

[Resin Particles (B)]

The resin particles (B) have a function as a resin binder for the toner.

The resin particles (B) used in the present invention contain a polyester in an amount of not less than 90% by mass on the basis of the resin component in the resin particles (B), from the viewpoint of improving low-temperature fusing property and durability of the resulting toner.

Similarly to the resin particles (B) forming a resin binder as a base material of the toner, by also incorporating the polyester into the resin particles (A) functioning as a dispersant for the releasing agent in such an amount that the content of the polyester in the resin particles (A) is not less than 90% by mass on the basis of the resin component therein, it is possible to enhance affinity between the releasing agent particles obtained in the step (1) and the resin particles (B). In addition, since no surfactant or merely a less amount of the surfactant is used therein, the releasing agent tends to be hardly desorbed from the aggregated particles even after aggregating the releasing agent particles and the resin particles. As a result, it is considered that the resulting toner can be improved in fusing property and durability. Furthermore, it is considered that since exposure of the releasing agent to a surface of the toner is suppressed, occurrence of toner cloud in the developing device can be suppressed.

From the same viewpoints as described above, the content of the polyester in the resin component constituting the resin particles (B) is preferably not less than 95% by mass, more preferably not less than 98% by mass, even more preferably substantially 100% by mass, and further even more preferably 100% by mass, on the basis of the resin component in the resin particles (B).

As the resin component constituting the resin particles (B), in addition to the polyester, there may also be used known resins used for the toner, for example, such as styrene-acrylic copolymers, epoxy resins, polycarbonates, polyurethanes, etc.

As described above, in the present invention, the acid component constituting the polyester in the resin particles (A) contains an aliphatic carboxylic acid component. By incorporating the aliphatic carboxylic acid component into the polyester as a constituent thereof, it is possible to improve flexibility of the polyester chain, and thereby obtain the resin particles (A) having a volume median particle size capable of rendering the releasing agent dispersible in the aqueous medium. In addition, in the present invention, the content of the aliphatic carboxylic acid as the raw material monomer constituting the polyester has been noticed as an index of the affinity between the polyesters. That is, in the step (2), assuming that the content of the aliphatic carboxylic acid component in the acid component constituting the polyester contained in the resin particles (A) and the content of the aliphatic carboxylic acid component in the acid component constituting the polyester contained in the resin particles (B) are represented by $S_A$ (% by mass) and $S_B$ (% by mass), respectively, it is preferred that $S_A$ is more than 0, and the absolute value of a difference between $S_A$ and $S_B$ ($|S_A-S_B|$) is not more than 20. The absolute value of the difference between $S_A$ and $S_B$ ($|S_A-S_B|$) is more preferably not more than 15, even more preferably not more than 12, further even more preferably not more than 10, and further even more preferably not more than 8, from the viewpoints of improving low-temperature fusing property and durability of the resulting toner, widening a temperature range in which the toner can be fused, and suppressing occurrence of toner cloud.

The content $S_B$ of the aliphatic carboxylic acid component in the acid component constituting the polyester contained in the resin particles (B) may be appropriately determined according to the absolute value of the difference between $S_A$ and $S_B$ and the value of $S_A$. The content $S_B$ is preferably more than 0% by mass, more preferably not less than 1% by mass, even more preferably not less than 5% by mass, further even more preferably not less than 10% by mass, further even more preferably not less than 20% by mass, and further even more preferably not less than 35% by mass, and is also preferably not more than 100% by mass, more preferably not more than 90% by mass, even more preferably not more than 80% by mass, further even more preferably not more than 70% by mass, further even more preferably not more than 55% by mass, and further even more preferably not more than 48% by mass.

The polyester used in the resin particles (B) may be produced by subjecting the acid component and the alcohol component to polycondensation reaction by the same method as used for production of the polyester used in the resin particles (A). Specific examples of the preferred acid component and alcohol component of the polyester used in the resin particles (B) are the same as those of the polyester used in the resin particles (A).

The glass transition temperature, softening point and acid value of the polyester used in the resin particles (B) preferably fall within the same ranges of the glass transition temperature, softening point and acid value of the polyester used in the resin particles (A).

In addition, the polyester used in the resin particles (B) may contain two kinds of polyesters that are different in softening point from each other.

(Production of Resin Particles (B))

The resin particles (B) are preferably produced by the method in which the resin component is dispersed, if required, together with the aforementioned optional components such as a surfactant in the aqueous medium, to obtain a dispersion of the resin particles (B).

The preferred form of the method of obtaining the dispersion containing the resin particles (B) is the same as that of the method of obtaining the dispersion containing the resin particles (A).

The resin particles (B) may also contain a colorant, a releasing agent and a charge control agent unless the effects of the present invention are adversely affected. Further, the resin particles (B) may also contain other additives such as a reinforcing filler such as fibrous substances, an antioxidant and an anti-aging agent, if required.

(Colorant)

The resin particles (B) may be in the form of resin particles constituted of a resin solely, or may be in the form of colorant-containing resin particles. However, from the viewpoint of obtaining uniform aggregated particles in the subsequent aggregating step, the resin particles (B) preferably contain a colorant, i.e., are preferably in the form of colorant-containing resin particles. The content of the colorant in the resin particles (B) if they are in the form of colorant-containing resin particles is preferably not less than 1 part by mass, and more preferably not less than 5 parts by mass, and is also preferably not more than 20 parts by mass, and more preferably not more than 10 parts by mass, on the basis of 100 parts by mass of the resin component constituting the resin particles (B), from the viewpoint of enhancing image density and low-temperature fusing property of the resulting toner.

The colorant used in the resin particles (B) may be either a pigment or a dye. From the viewpoint of enhancing image density of the resulting toner, the pigment is preferably used.

Specific examples of the pigment include carbon blacks, inorganic composite oxides, Benzidine Yellow, Brilliant Carmine 3B, Brilliant Carmine 6B, red iron oxide, Aniline Blue, ultramarine blue, copper phthalocyanine and Phthalocyanine Green. Among these pigments, preferred is copper phthalocyanine.

Specific examples of the dye include acridine dyes, azo dyes, benzoquinone dyes, azine dyes, anthraquinone dyes, indigo dyes, phthalocyanine dyes and Aniline Black dyes.

These colorants may be used alone or in combination of any two or more thereof.

[Production of Resin Particles (B)]

The resin particles (B) are preferably produced by the method in which the resin component containing the polyester, the surfactant and the aforementioned optional components such as a colorant are mixed in an aqueous medium to obtain a dispersion of the resin particles (B).

The aqueous medium used above preferably contains water as a main component. The content of water in the aqueous medium is preferably not less than 80% by mass, more preferably not less than 90% by mass, even more preferably not less than 95% by mass, further even more preferably substantially 100% by mass, and further even more preferably 100% by mass, and is also preferably not more than 100% by mass, from the viewpoints of attaining good environmental suitability and improving dispersion stability of the releasing agent particles. As the water, deionized water or distilled water is preferably used.

The components other than water in the aqueous medium are preferably the same as those of the aqueous medium used for producing the releasing agent particles in the step (1).

The preferred form of the method of obtaining the dispersion containing the resin particles (B) is the same as that of the method of obtaining the dispersion containing the resin particles (A).

From the viewpoint of improving low-fusing property and durability of the resulting toner, the polyester constituting the resin particles (B) is preferably crosslinked, and more preferably crosslinked using an oxazoline-containing compound.

The oxazoline-containing compound used for crosslinking the polyester is the same as that optionally used above for producing the releasing agent p articles.

The content of the oxazoline-containing compound in the dispersion of the resin particles (B) or the amount of the oxazoline-containing compound added thereto is preferably not less than 0.1 part by mass, more preferably not less than 0.5 part by mass, and even more preferably not less than 0.8 part by mass, and is also preferably not more than 30 parts by mass, more preferably not more than 20 parts by mass, and even more preferably not more than 10 parts by mass, in terms of solid components therein, on the basis of 100 parts by mass of the resin component in the resin particles (B), from the viewpoint of enhancing crosslinking reactivity with the resins as well as productivity of the toner.

The oxazoline-containing compound is added and mixed in the resin dispersion to thereby crosslink the polyester contained in the resin particles (B) dispersed therein. The temperature used upon the crosslinking reaction is preferably not lower than 60° C., and more preferably not lower than 70° C., and is also preferably not higher than 100° C., and more preferably not higher than 98° C. The presence of the crosslinked structure may be determined by analyzing the presence of an amide group in the resulting product by methods such as infrared absorption spectrometry.

The solid content of the dispersion of the resin particles (B) is preferably not less than 10% by mass, more preferably not less than 15% by mass, and even more preferably not less than 20% by mass, and is also preferably not more than 50% by mass, more preferably not more than 40% by mass, and even more preferably not more than 35% by mass, from the viewpoints of improving dispersion stability of the dispersion of the resin particles, facilitating handling of the dispersion of the resin particles, and enhancing productivity of the toner. Meanwhile, the solid content as used herein means the value based on non-volatile components including the resins, pigments, surfactants and the like.

The volume median particle size ($D_{50}$) of the resin particles (B) contained in the dispersion of the resin particles (B) is preferably not less than 0.02 μm, more preferably not less than 0.05 μm, even more preferably not less than 0.08 μm, and further even more preferably not less than 0.10 μm, and is also preferably not more than 1.00 μm, more preferably not more than 0.50 μm, even more preferably not more than 0.30 μm, further even more preferably not more than 0.20 μm, and further even more preferably not more than 0.15 μm, from the viewpoint of obtaining the toner capable of producing high-quality images.

The coefficient of variation of particle size distribution (CV: %) of the resin particles (B) is preferably not more than 40%, more preferably not more than 35%, and even more preferably not more than 30%, from the viewpoint of obtaining the toner capable of producing high-quality images, and is also preferably not less than 5%, more preferably not less than 10%, and even more preferably not less than 15%, from the viewpoint of enhancing productivity of the dispersion of the resin particles (B). Meanwhile, the CV means the value represented by the following formula, and may be determined by the method as described in Examples below.

$$CV\ (\%)=[\text{Standard Deviation of Particle Size Distribution } (\mu m)/\text{Volume Average Particle Size } (\mu m)]\times 100.$$

[Step (2A)]

In the step (2A), the dispersion of the releasing agent particles, the dispersion of the resin particles (B) and the aggregating agent are mixed with each other in the aqueous medium to obtain aggregated particles (1). In this case, it is preferred that the dispersion of the releasing agent particles, the dispersion of the resin particles (B) and the aggregating agent as well as, if required, the aqueous medium are added and mixed to prepare a dispersion of the aggregated particles (1).

(Production of Aggregated Particles (1))

The aggregated particles (1) are produced by the method in which the resin particles (B), the releasing agent particles, the aggregating agent and the optional components such as a colorant are mixed in the aqueous medium to obtain the aggregated particles (1). In this case, the above respective components are preferably aggregated when mixed with each other to thereby obtain the aggregated particles (1) in the form of a dispersion thereof.

First, the resin particles (B) and the releasing agent particles are mixed in the aqueous medium to obtain a mixed dispersion.

Meanwhile, when no colorant is mixed in the resin particles (B), the colorant is preferably mixed in the mixed dispersion.

In addition, the mixed dispersion may also contain resin particles other than the resin particles (B) unless the effects of the present invention are adversely affected.

The order of mixing of the respective components is not particularly limited, and these components may be added either sequentially or simultaneously.

The content of the resin particles (B) in the mixed dispersion containing the resin particles (B) and the releasing agent particles is preferably not less than 10 parts by mass, and more preferably not less than 15 parts by mass, and is also preferably not more than 40 parts by mass, and more preferably not more than 30 parts by mass, on the basis of 100 parts by mass of the mixed dispersion, from the viewpoints of improving low-temperature fusing property of the resulting toner and enhancing productivity of the toner.

The content of the aqueous medium in the mixed dispersion containing the resin particles (B) and the releasing agent particles is preferably not less than 50 parts by mass, and more preferably not less than 60 parts by mass, and is also preferably not more than 85 parts by mass, and more preferably not more than 80 parts by mass, on the basis of 100 parts by mass of the mixed dispersion, from the viewpoints of enhancing productivity of the toner and well controlling aggregation of the particles to obtain aggregated particles having a particle size as desired.

Also, the content of the colorant in the mixed dispersion is preferably not less than 2 parts by mass, and more preferably not less than 3 parts by mass, and is also preferably not more than 20 parts by mass, and more preferably not more than 10 parts by mass, on the basis of 100 parts by mass of the resin component constituting the resin particles (B), from the viewpoint of enhancing toner image density and improving low-temperature fusing property of the resulting toner.

The content of the releasing agent particles in the mixed dispersion is preferably not less than 2 parts by mass, and more preferably not less than 5 parts by mass, and is also preferably not more than 20 parts by mass, and more preferably not more than 15 parts by mass, on the basis of 100 parts by mass of the resin particles (B), from the viewpoints of improving releasing property and charging property of the resulting toner.

The mixing temperature used above is preferably not lower than 0° C. and not higher than 40° C., from the viewpoint of well controlling aggregation of the particles to obtain aggregated particles having a particle size as desired.

Next, the particles in the mixed dispersion are aggregated together, so that it is possible to suitably obtain a dispersion of the aggregated particles (1). In this case, an aggregating agent is preferably added to the mixed dispersion in order to efficiently conduct aggregation of the particles.

Specific examples of the aggregating agent used above include organic aggregating agents such as a cationic surfactant in the form of a quaternary salt and polyethyleneimine; and inorganic aggregating agents such as an inorganic metal salt, an inorganic ammonium salt and a divalent or higher-valent metal complex.

Specific examples of the inorganic metal salt include metal salts such as sodium sulfate, sodium chloride, calcium chloride, magnesium sulfate, calcium nitrate, magnesium chloride, zinc chloride, aluminum chloride and aluminum sulfate; and inorganic metal salt polymers such as poly (aluminum chloride) and poly(aluminum hydroxide). Specific examples of the inorganic ammonium salt include ammonium sulfate, ammonium chloride and ammonium nitrate.

The aggregating agent used in the present invention is preferably in the form of an electrolyte and more preferably a salt, from the viewpoint of obtaining a toner having a desired particle size while preventing excessive aggregation thereof. The valence of the salt as the aggregating agent is preferably from mono- to penta-valence, more preferably from mono- to di-valence, and even more preferably monovalence. That is, it is preferable to use a monovalent salt as the aggregating agent. The monovalent salt as used herein means that the valence of a metal ion or a cation constituting the salt is 1 (monovalence). As the monovalent salt, the aforementioned inorganic metal salts and inorganic ammonium salts are used, and the inorganic ammonium salts are preferably used.

Of these aggregating agents, from the viewpoint of improving aggregating property of the particles to obtain uniform aggregated particles, preferred are the inorganic ammonium salts, and more preferred is ammonium sulfate.

The amount of the aggregating agent used is preferably not more than 50 part by mass, more preferably not more than 40 part by mass, and even more preferably not more than 35 part by mass, on the basis of 100 parts by mass of the respective resin components constituting the resin particles (A) and the resin particles (B), from the viewpoint of improving durability of the resulting toner, and is also preferably not less than 1 parts by mass, more preferably not less than 10 parts by mass, and even more preferably not less than 20 parts by mass, on the basis of 100 parts by mass of the respective resin components constituting the resin particles (A) and the resin particles (B), from the viewpoint of well controlling aggregation of the resin particles to obtain aggregated particles having a desired particle size.

As the aggregating method, there may be mentioned a method in which the aggregating agent, preferably a solution of the aggregating agent in an aqueous medium, is added dropwise into a vessel filled with the mixed dispersion. The aggregating agent to be added dropwise is preferably in the form of an aqueous solution, from the viewpoint of well controlling aggregation of the resin particles to obtain aggregated particles having a desired particle size. The concentration of the aqueous solution of the aggregating agent is preferably not less than 3% by mass, more preferably not less than 5% by mass, and even more preferably not less than 7% by mass, and is also preferably not more than 30% by mass, more preferably not more than 20% by mass, and even more preferably not more than 15% by mass, from the viewpoint of well controlling aggregation of the resin particles to obtain aggregated particles having a desired particle size. In this case, the aggregating agent may be added at one time, or continuously or intermittently. Further, the aggregating agent may be split-added plural times. Upon and after adding the aggregating agent, the obtained dispersion is preferably fully stirred.

From the viewpoints of well controlling aggregation of the particles to obtain aggregated particles having a desired particle size and enhancing productivity of the toner, the dropwise addition time of the aggregating agent is preferably not less than 1 min and not more than 120 min. The temperature upon the dropwise addition of the aggregating agent is preferably not lower than 0° C. and not higher than 50° C., from the viewpoint of well controlling aggregation of the particles to obtain aggregated particles having a desired particle size.

Furthermore, from the viewpoints of promoting aggregation of the particles and well controlling a particle size of the resulting aggregated particles to suppress production of coarse particles, the temperature of the dispersion obtained after adding the aggregating agent to the mixed dispersion is preferably raised. The temperature of the dispersion to be maintained is preferably not lower than 50° C. and not higher than 70° C. It is preferred that the progress of the aggregation of the particles is confirmed by monitoring a volume median particle size of the resulting aggregated particles. The volume median particle size may be measured by the method described in Examples below.

From the viewpoints of obtaining the toner capable of producing high-quality images and suppressing occurrence of toner cloud, the volume median particle size of the resulting aggregated particles (1) is preferably not more than 10 μm, more preferably not more than 8 μm, and even more preferably not more than 6 μm, and is also preferably not less than 1 μm, more preferably not less than 2 μm, and even more preferably not less than 3 μm. The volume median particle size of the aggregated particles (1) may be specifically measured by the method described in Examples below.

[Step (2B)]

In the step (2B), the resin particles (B) are added to the aggregated particles (1) obtained in the step (2A) at one time or plural times in a split addition manner to obtain aggregated particles (2) in which the resin particles (B) are adhered onto the aggregated particles (resin particle (B)-deposited aggregated particles). In this case, the resin particles (B) are preferably added to the dispersion of the aggregated particles (1) as described in the step (2A) at one time or plural times in a split addition manner to obtain aggregated particles (2) in which the resin particles (B) are adhered onto the aggregated particles (resin particle (B)-deposited aggregated particles).

By conducting the step (2B), it is possible to effectively prevent isolation of the releasing agent, etc., from the resulting toner particles.

In the case where the resin particles (B) are split-added plural times to the dispersion, the amounts of the respective split parts of the resin particles (B) to be split-added are preferably identical to each other. Also, in the case where the resin particles (B) are split-added plural times to the dispersion, the number of times of split addition of the resin particles (B) is not particularly limited, and is preferably not less than 2, from the viewpoint of well controlling a particle size of the aggregated particles (2) thus formed, and is also preferably not more than 10, and more preferably not more than 8, from the viewpoint of enhancing productivity of the aggregated particles (2).

The resin particles (B) used in the step (2B) may be the same as the resin particles (B) used in the step (2A), or may be different in composition therefrom. However, from the viewpoints of improving low-temperature fusing property and durability of the resulting toner and enhancing productivity of the toner, the resin particles (B) used in the step (2B) are preferably the same as the resin particles (B) used in the step (2A).

The time of addition of the resin particles (B) in the step (2B) is not particularly limited as long as the resin particles (B) can be adhered onto the aggregated particles (1). From the viewpoint of well controlling a particle size of the resulting aggregated particles (2), the resin particles (B) are preferably added between after completion of the first addition of the aggregating agent and before initiation of the coalescing step.

In the case where the dispersion of the resin particles (B) is added to the dispersion of the aggregated particles (1), the aforementioned aggregating agent may be added in the step (2B) in order to allow the resin particles (B) to efficiently adhere onto the aggregated particles (1).

The temperature in the reaction system of the step (2B) is preferably not lower than 50° C. and not higher than 70° C., from the viewpoint of improving low-temperature fusing property and durability of the resulting toner. When the aggregated particles (2) are produced within the aforementioned temperature range, the resulting toner can exhibit good low-temperature fusing property and durability. The reason for attaining the above effects is considered as follows, though not clearly determined. That is, it is considered that the aggregated particles (2) are prevented from coalescing together, so that production of coarse particles can be suppressed, The compounding mass ratio of the aggregated particles (1) in the dispersion of the aggregated particles (2) to the resin particles (B) added in the step (2B) (aggregated particles (1)/resin particles (B)) is preferably not less than 0.1, more preferably not less than 0.5, even more preferably not less than 1.0, further even more preferably not less than 1.5, and further even more preferably not less than 2.0, and is also preferably not more than 5.0, more preferably not more than 4.0, and even more preferably not more than 3.5, from the viewpoint of improving low-temperature fusing property and durability of the resulting toner.

The volume median particle size ($D_{50}$) of the aggregated particles (2) is preferably not less than 1 μm, more preferably not less than 2 μm, even more preferably not less than 3 μm, and further even more preferably not less than 4 μm, and is also preferably not more than 10 μm, more preferably not more than 9 μm, even more preferably not more than 8 μm, and further even more preferably not more than 6 μm, from the viewpoint of obtaining the toner capable of producing high-quality images.

At the time at which growth of particles having an appropriate particle size as that of the toner is achieved by adding the resin particles (B), the aggregating step is stopped.

As the method of stopping the aggregating step, there may be used a method of cooling the dispersion, a method of adding an aggregation stopping agent to the dispersion, etc. Of these methods, from the viewpoint of surely preventing occurrence of unnecessary aggregation of the particles, preferred is the method of adding an aggregation stopping agent to the dispersion to stop the aggregating step.

As the aggregation stopping agent, a surfactant is preferably used. The aggregation stopping agent used is more preferably an anionic surfactant. Examples of the anionic surfactants include alkylethersulfuric acid salts, alkylsulfuric acid salts, straight-chain alkylbenzenesulfonic acid salts and polyoxyethylene alkylethersulfuric acid salts. Of these aggregation stopping agents, preferred are polyoxyethylene alkylethersulfuric acid salts, and more preferred is sodium polyoxyethylene laurylethersulfate.

These aggregation stopping agents may be used alone or in combination of any two or more thereof.

The amount of the aggregation stopping agent added is preferably not less than 0.1 part by mass, more preferably not less than 1 part by mass, and even more preferably not less than 2 parts by mass, on the basis of 100 parts by mass of the resin component constituting the aggregated particles (1) or the resin component constituting the aggregated particles (2) (i.e., a total amount of the resin component constituting the aggregated particles (1) and the resin component constituting the resin particles (B)), from the viewpoint of stopping aggregation of the particles, and is also preferably not more than 10 parts by mass, and more preferably not more than 5 parts by mass, on the basis of 100 parts by mass of the resin component constituting the aggregated particles (1) or the resin component constituting the aggregated particles (2), from the viewpoint of reducing an amount of the aggregation stopping agent remaining in the resulting toner. The aggregation stopping agent may be used in any configuration as long as the amount of the aggregation stopping agent added lies within the above-specified range. However, the aggregation stopping agent is preferably added in the form of an aqueous solution thereof, from the viewpoint of enhancing a productivity of the toner.

The temperature upon adding the aggregation stopping agent to the dispersion is preferably the same as the temperature at which the dispersion of the aggregated particles is to be maintained, more specifically, not lower than 50° C. and not higher than 70° C., from the viewpoint of enhancing productivity of the toner.

<Step (3)>

In the step (3), the aggregated particles obtained in the step (2) are coalesced together to obtain coalesced particles.

The "aggregated particles obtained in the step (2)" as used herein mean the aggregated particles (1) obtained in the step (2A) in the case where the step (2B) is not carried out, and also mean the aggregated particles (2) obtained in the step (2B) in the case where the step (2B) is carried out.

It is estimated that the resin particles or releasing agent particles contained in the aggregated particles obtained in the step (2) which are adhered to each other mainly by a physical force only are integrally coalesced together during the coalescing step to thereby form the coalesced particles.

From the viewpoints of improving coalescing property of the aggregated particles and enhancing productivity of the toner, the heating temperature used upon the coalescing step is preferably not lower than a glass transition temperature of the resin component constituting the aggregated particles (2) and not higher than 100° C., more preferably not lower than the glass transition temperature of the resin component constituting the aggregated particles (2) and not higher than 90° C., and even more preferably not lower than the glass transition temperature of the resin component constituting the aggregated particles (2) and not higher than 85° C.

The retention time of the step (3) is preferably not less than 10 min, more preferably not less than 30 min, and even more preferably not less than 1 h, and is also preferably not more than 24 h, more preferably not more than 10 h, even more preferably not more than 5 h, and further even more preferably not more than 3 h, from the viewpoints of improving coalescing property of the aggregated particles and enhancing durability, charging property and productivity of the toner.

From the viewpoint of attaining a high-quality toner image, the volume median particle size of the coalesced particles obtained in the step (3) is preferably not less than 2 μm, more preferably not less than 3 μm, and even more preferably not less than 4 μm, and is also preferably not more than 10 μm, more preferably not more than 8 μm, even more preferably not more than 7 μM, and further even more preferably not more than 6 μm.

Meanwhile, the average particle size of the coalesced particles obtained in the step (3) is preferably not more than an average particle size of the aggregated particles (2). That is, in the step (3), the coalesced particles are preferably free from aggregation and coalescence therebetween.

[Additional Treatment Step]

In the present invention, after completion of the step (3), the obtained dispersion may be subjected to an additional treatment step. In the additional treatment step, the coalesced particles are preferably isolated from the dispersion to obtain toner particles.

The coalesced particles obtained in the step (3) are present in the aqueous medium. Therefore, the dispersion containing the coalesced particles is preferably first subjected to solid-liquid separation. The solid-liquid separation procedure is preferably conducted by a suction filtration method, etc.

The particles obtained by the solid-liquid separation are then preferably subjected to rinsing treatment. In this case, when using the nonionic surfactant upon producing the resin particles (A) and (B), it is preferred that the nonionic surfactant added is also removed by the rinsing treatment. Therefore, the resulting particles are preferably rinsed with an aqueous medium at a temperature not higher than a cloud point of the nonionic surfactant. The rinsing treatment is preferably carried out plural times.

Next, the thus treated toner particles are preferably dried. The temperature upon drying the coalesced particles is preferably controlled such that the temperature of the coalesced particles themselves is preferably lower by not less than 5° C. than a glass transition temperature of the resin component constituting the coalesced particles, and more preferably lower by not less than 10° C. than the glass transition temperature.

As the drying method, there are preferably used optional methods such as a vacuum low-temperature drying method, a vibration-type fluidization drying method, a spray-drying method, a freeze-drying method and a flash jet method, etc. The content of water in the toner particles obtained after drying is preferably adjusted to not more than 1.5% by mass, and more preferably not more than 1.0% by mass, from the viewpoint of improving charging property of the resulting toner.

The volume median particle size ($D_{50}$) of the toner particles or the below-mentioned toner is preferably not less than 2 μm, more preferably not less than 3 μm, and even more preferably not less than 4 μm, and is also preferably not more than 10 μm, more preferably not more than 8 μm, even more preferably not more than 7 μm, and further even more preferably not more than 6 μm, from the viewpoints of obtaining high-quality toner images.

The CV of the toner particles or the below-mentioned toner is preferably not more than 30%, more preferably not more than 28%, and even more preferably not more than 27%, from the viewpoints of improving a quality of the obtained toner images, and is also preferably not less than 5%, more preferably not less than 10%, and even more preferably not less than 15%, from the viewpoint of enhancing productivity of the toner.

The volume median particle size ($D_{50}$) and CV of the toner particles may be determined by the methods described in Examples below.

[Toner for Development of Electrostatic Images]

The toner particles obtained by the drying, etc., may be directly used as the toner according to the present invention. However, it is preferred that the toner particles are subjected to the below-mentioned surface treatment, and the thus surface-treated toner particles are used as the toner for development of electrostatic images.

The softening point of the toner for development of electrostatic images according to the present invention is preferably not lower than 60° C., and is also preferably not higher than 140° C., more preferably not higher than 130°

C., and even more preferably not higher than 120° C., from the viewpoint of improving low-temperature fusing property and durability of the resulting toner.

The toner particles as the toner for development of electrostatic images thus obtained according to the production process of the present invention may be directly used as a toner. However, the toner particles are preferably subjected to surface treatment in which an aid such as a fluidizing agent is applied as an external additive onto a surface of the respective toner particles, and the resulting surface-treated toner particles may be used as the toner. Examples of the external additive include inorganic fine particles such as hydrophobic treated silica fine particles, titanium oxide fine particles, alumina fine particles, cerium oxide fine particles and carbon blacks; and polymer fine particles such as fine particles of polycarbonates, polymethyl methacrylate, silicone resins, etc. Of these fine particles, preferred are hydrophobic silica fine particles.

The amount of the external additive added to the toner is preferably not less than 1 part by mass, more preferably not less than 2 parts by mass, and even more preferably not less than 3 parts by mass, and is also preferably not more than 5 parts by mass, and more preferably not more than 4.7 parts by mass, on the basis of 100 parts by mass of the toner particles before being treated with the external additive.

The toner for development of electrostatic images which is obtained according to the present invention can be used as one component developer, or can be mixed with a carrier to form a two component developer.

The kit for producing a dispersion of releasing agent particles according to the present invention which includes a surfactant in an amount of not more than 0.5 part by mass on the basis of 100 parts by mass of the releasing agent in the dispersion, includes the releasing agent, and the dispersion of the resin particles (A) containing the polyester in an amount of not less than 90% by mass on the basis of a resin component in the resin particles (A). The preferred examples of the releasing agent and the dispersion of the resin particles (A) are the same as those described above. The absolute amounts of the respective components in the kit as described in the present specification are not particularly limited as long as the kit includes the aforementioned components, and may be merely a small amount or an adequate amount used for industrial production thereof.

The kit for producing the toner for development of electrostatic images according to the present invention includes the releasing agent, the dispersion of the resin particles (A) containing the polyester in an amount of not less than 90% by mass on the basis of a resin component in the resin particles (A), and the dispersion of the resin particles (B) containing the polyester in an amount of not less than 90% by mass on the basis of a resin component in the resin particles (B). The preferred examples of the releasing agent, the dispersion of the resin particles (A) and the dispersion of the resin particles (B) are the same as those described above.

In the present specification, in addition to the aforementioned embodiments, there are further described the following aspects concerning the process for producing a toner for development of electrostatic images, etc.

<1> A process for producing a toner for development of electrostatic images, including the following steps (1) to (3):

step (1): mixing and emulsifying a releasing agent and a dispersion of resin particles (A) containing a polyester in an amount of not less than 90% by mass on the basis of a resin component in the resin particles (A) to obtain a dispersion of releasing agent particles;

step (2): mixing and aggregating the dispersion of the releasing agent particles obtained in the step (1) and a dispersion of resin particles (B) containing a polyester in an amount of not less than 90% by mass on the basis of a resin component in the resin particles (B) to obtain aggregated particles; and step (3): coalescing the aggregated particles obtained in the step (2) to obtain coalesced particles, in which an acid component constituting the polyester in the resin particles (A) contains an aliphatic carboxylic acid; the resin particles (A) have a volume median particle size of not less than 0.02 μm and not more than 0.50 μm; and a content of a surfactant in the dispersion of the releasing agent particles is not more than 0.5 part by mass on the basis of 100 parts by mass of the releasing agent.

<2> A process for producing a toner for development of electrostatic images, including the following steps (1) to (3):

step (1): mixing and emulsifying a releasing agent and a dispersion of resin particles (A) containing a polyester in an amount of not less than 90% by mass on the basis of a resin component in the resin particles (A) to obtain a dispersion of releasing agent particles;

step (2): mixing and aggregating the dispersion of the releasing agent particles obtained in the step (1) and a dispersion of resin particles (B) containing a polyester in an amount of not less than 90% by mass on the basis of a resin component in the resin particles (B) to obtain aggregated particles; and step (3): coalescing the aggregated particles obtained in the step (2) to obtain coalesced particles, in which the resin particles (A) have a volume median particle size of not less than 0.02 μm and not more than 0.50 μm.

<3> The process for producing a toner for development of electrostatic images according to the above aspect <1> or <2>, wherein the step (2) includes the following steps (2A) and (2B):

step (2A): mixing the dispersion of the releasing agent particles obtained in the step (1), the dispersion of the resin particles (B) and an aggregating agent with each other in an aqueous medium to obtain aggregated particles (1); and step (2B): adding the resin particles (B) to the aggregated particles (1) obtained in the step (2A) at one time or plural times in a split addition manner to obtain aggregated particles (2) in which the resin particles (B) are adhered onto the aggregated particles.

<4> The process for producing a toner for development of electrostatic images according to any one of the above aspects <1> to <3>, wherein the releasing agent includes a vegetable wax and a mineral or petroleum wax, and preferably a carnauba wax and a paraffin wax.

<5> The process for producing a toner for development of electrostatic images according to any one of the above aspects <1> to <4>, wherein a content of water in the dispersing medium in the dispersion of the resin particles (A) is preferably not less than 80% by mass, more preferably not less than 90% by mass, even more preferably not less than 95% by mass, further even more preferably substantially 100% by mass, and further even more preferably 100% by mass, and is also not more than 100% by mass.

<6> The process for producing a toner for development of electrostatic images according to any one of the above aspects <1> to <5>, wherein a melting point of the releasing agent is preferably not lower than 60° C., more preferably not lower than 65° C., and even more preferably not lower than 70° C., and is also preferably not higher than 100° C., more preferably not higher than 95° C., even more preferably not higher than 90° C., and further even more preferably not higher than 85° C.

<7> The process for producing a toner for development of electrostatic images according to any one of the above aspects <1> to <6>, wherein a volume median particle size of the resin particles (A) is preferably not less than 0.05 μm, and more preferably not less than 0.10 μm, and is also preferably not more than 0.40 μm, more preferably not more than 0.30 μm, even more preferably not more than 0.20 μm, further even more preferably not more than 0.15 μm, and further even more preferably not more than 0.12 μm.

<8> The process for producing a toner for development of electrostatic images according to any one of the above aspects <1> to <7>, wherein a coefficient of variation of particle size distribution (CV: %) of the resin particles (A) is preferably not more than 40%, more preferably not more than 35%, and even more preferably not more than 30%, and is also preferably not less than 5%, more preferably not less than 10%, and even more preferably not less than 15%.

<9> The process for producing a toner for development of electrostatic images according to any one of the above aspects <1> to <8>, wherein a mass ratio of the releasing agent to the resin particles (A) [releasing agent/resin particles (A)] is preferably from 99/1 to 51/49, more preferably from 97/3 to 60/40, even more preferably from 95/5 to 70/30, and further even more preferably from 95/5 to 80/20.

<10> The process for producing a toner for development of electrostatic images according to any one of the above aspects <1> to <9>, wherein a volume median particle size ($D_{50}$) of the releasing agent particles is preferably not less than 0.05 μm, more preferably not less than 0.20 μm, even more preferably not less than 0.40 μm, and further even more preferably not less than 0.50 μm, and is also preferably not more than 1.00 μm, more preferably not more than 0.80 μm, even more preferably not more than 0.70 μm, further even more preferably not more than 0.65 μm, and further even more preferably not more than 0.60 μm.

<11> The process for producing a toner for development of electrostatic images according to any one of the above aspects <1> to <10>, wherein a coefficient of variation of particle size distribution (CV: %) of the releasing agent particles is preferably not more than 50%, more preferably not more than 40%, and even more preferably not more than 37%, and is also preferably not less than 15%, more preferably not less than 20%, and even more preferably not less than 25%.

<12> The process for producing a toner for development of electrostatic images according to any one of the above aspects <1> to <11>, wherein in the step (2), assuming that a content of the aliphatic carboxylic acid component in the acid component constituting the polyester contained in the resin particles (A) and a content of the aliphatic carboxylic acid component in the acid component constituting the polyester contained in the resin particles (B) are represented by $S_A$ (% by mass) and $S_B$ (% by mass), respectively, $S_A$ is more than 0, and an absolute value of a difference between $S_A$ and $S_B$ ($|S_A-S_B|$) is preferably not more than 20, more preferably not more than 15, even more preferably not more than 12, further even more preferably not more than 10, and further even more preferably not more than 8.

<13> The process for producing a toner for development of electrostatic images according to any one of the above aspects <1> to <12>, wherein the content $S_A$ of the aliphatic carboxylic acid component in the acid component constituting the polyester contained in the resin particles (A) is preferably not less than 1% by mass, more preferably not less than 3% by mass, even more preferably not less than 10% by mass, further even more preferably not less than 20% by mass, and further even more preferably not less than 25% by mass, and is also preferably not more than 100% by mass, more preferably not more than 90% by mass, even more preferably not more than 80% by mass, further even more preferably not more than 70% by mass, further even more preferably not more than 55% by mass, and further even more preferably not more than 48% by mass.

<14> The process for producing a toner for development of electrostatic images according to any one of the above aspects <1> to <13>, wherein a content of water in the dispersing medium in the dispersion of the resin particles (B) is preferably not less than 80% by mass, more preferably not less than 90% by mass, even more preferably not less than 95% by mass, further even more preferably substantially 100% by mass, and further even more preferably 100% by mass, and is also not more than 100% by mass.

<15> The process for producing a toner for development of electrostatic images according to any one of the above aspects <1> to <14>, wherein a volume median particle size ($D_{50}$) of the resin particles (B) is preferably not less than 0.02 μm, more preferably not less than 0.05 μm, even more preferably not less than 0.08 μm, and further even more preferably not less than 0.10 μm, and is also preferably not more than 1.00 μm, more preferably not more than 0.50 μm, even more preferably not more than 0.30 μm, further even more preferably not more than 0.20 μm, and further even more preferably not more than 0.15 μm.

<16> The process for producing a toner for development of electrostatic images according to any one of the above aspects <1> to <15>, wherein a coefficient of variation of particle size distribution (CV: %) of the resin particles (B) is preferably not more than 40%, more preferably not more than 35%, and even more preferably not more than 30%, and is also preferably not less than 5%, more preferably not less than 10%, and even more preferably not less than 15%.

<17> The process for producing a toner for development of electrostatic images according to any one of the above aspects <1> to <16>, wherein the aliphatic carboxylic acid component in the acid component constituting the polyester contained in the resin particles (A) includes at least one acid selected from the group consisting of fumaric acid, adipic acid, succinic acid and succinic acids substituted with an alkenyl group having not less than 2 and not more than 20 carbon atoms, and preferably fumaric acid.

<18> The process for producing a toner for development of electrostatic images according to any one of the above aspects <1> to <17>, wherein the aliphatic carboxylic acid component in the acid component constituting the polyester contained in the resin particles (B) includes at least one acid selected from the group consisting of fumaric acid, adipic acid, succinic acid and succinic acids substituted with an alkenyl group having not less than 2 and not more than 20 carbon atoms, and preferably fumaric acid.

<19> The process for producing a toner for development of electrostatic images according to any one of the above aspects <1> to <18>, wherein a content of the polyester in the resin component constituting the resin particles (A) is preferably not less than 95% by mass, more preferably not less than 98% by mass, even more preferably substantially 100% by mass, and further even more preferably 100% by mass, and is also not more than 100% by mass.

<20> The process for producing a toner for development of electrostatic images according to any one of the above aspects <1> to <19>, wherein in the step (1), a dispersion-stabilizing aid is further mixed.

<21> The process for producing a toner for development of electrostatic images according to the above aspect <20>, wherein the dispersion-stabilizing aid is a compound containing a functional group capable of reacting with a carboxy group, and the functional group capable of reacting with a carboxy group is preferably an oxazoline group, an epoxy group, an aziridine group or a carbodiimide group, more preferably an oxazoline group or an epoxy group, and even more preferably an oxazoline group.

<22> The process for producing a toner for development of electrostatic images according to the above aspect <20> or <21>, wherein an amount of the dispersion-stabilizing aid added to the dispersion is preferably not less than 0.2 part by mass, more preferably not less than 0.5 part by mass, and even more preferably not less than 0.7 part by mass, and is also preferably not more than 5 parts by mass, more preferably not more than 2 parts by mass, and even more preferably not more than 1 part by mass, in terms of solid components therein, on the basis of 100 parts by mass of the releasing agent.

<23> The process for producing a toner for development of electrostatic images according to any one of the above aspects <1> to <22>, wherein a content of the surfactant in the dispersion of the releasing agent particles is not more than 0.5 part by mass, preferably not more than 0.3 part by mass, and more preferably not more than 0.2 part by mass, on the basis of 100 parts by mass of the releasing agent.

<24> The process for producing a toner for development of electrostatic images according to any one of the above aspects <1> to <23>, wherein a content of the polyester in the resin component constituting the resin particles (B) is preferably not less than 95% by mass, more preferably not less than 98% by mass, even more preferably substantially 100% by mass, and further even more preferably 100% by mass.

<25> The process for producing a toner for development of electrostatic images according to any one of the above aspects <1> to <24>, wherein the alcohol component constituting the polyester contained in the resin particles (A) includes an aromatic diol.

<26> The process for producing a toner for development of electrostatic images according to the above aspect <25>, wherein the aromatic diol is an alkylene (having not less than 2 and not more than 3 carbon atoms) oxide adduct (average molar number of addition of alkyleneoxide: not less than 1 and not more than 16) of bisphenol A.

<27> A process for producing a dispersion of releasing agent particles, including the following step (1):

step (1): mixing and emulsifying a releasing agent and a dispersion of resin particles (A) containing a polyester in an amount of not less than 90% by mass on the basis of a resin component in the resin particles (A) to obtain the dispersion of the releasing agent particles, in which an acid component constituting the polyester in the resin particles (A) contains an aliphatic carboxylic acid; the resin particles (A) have a volume median particle size of not less than 0.02 μm and not more than 0.50 μm; and a content of a surfactant in the dispersion of the releasing agent particles is not more than 0.5 part by mass on the basis of 100 parts by mass of the releasing agent.

<28> A kit for producing a dispersion of releasing agent particles which contains a surfactant in an amount of not more than 0.5 part by mass on the basis of 100 parts by mass of the releasing agent in the dispersion, the kit including the releasing agent, and a dispersion of resin particles (A) containing a polyester in an amount of not less than 90% by mass on the basis of a resin component in the resin particles (A), in which an acid component constituting the polyester in the resin particles (A) contains an aliphatic carboxylic acid; and the resin particles (A) have a volume median particle size of not less than 0.02 μm and not more than 0.50 μm.

<29> The kit according to the above aspect <28>, wherein the releasing agent includes a vegetable wax and a petroleum wax.

<30> A kit for producing a toner for development of electrostatic images, including a releasing agent, a dispersion of resin particles (A) containing a polyester in an amount of not less than 90% by mass on the basis of a resin component in the resin particles (A), and a dispersion of resin particles (B) containing a polyester in an amount of not less than 90% by mass on the basis of a resin component in the resin particles (B), including the releasing agent, and the dispersion of the resin particles (A) containing the polyester in an amount of not less than 90% by mass on the basis of the resin component in the resin particles (A), in which an acid component constituting the polyester in the resin particles (A) contains an aliphatic carboxylic acid; and the resin particles (A) have a volume median particle size of not less than 0.02 μM and not more than 0.50 μm.

<31> The kit according to the above aspect <30>, wherein the releasing agent includes a vegetable wax and a mineral or petroleum wax.

EXAMPLES

Respective properties of polyesters, resin particles, toners, etc., were measured and evaluated by the following methods.

[Acid Value of Resin]

Measured by the same method as prescribed in JIS K0070 except that a mixed solvent containing acetone and toluene at a volume ratio (acetone:toluene) of 1:1 was used as a solvent for the measurement.

[Softening Points of Resin and Toner]

Using a flow tester "CFT-500D" available from Shimadzu Corporation, 1 g of a sample was extruded through a nozzle having a die pore diameter of 1 mm and a length of 1 mm while heating the sample at a temperature rise rate of 6° C./min and applying a load of 1.96 MPa thereto by a plunger. The softening point was determined as the temperature at which a half amount of the sample was flowed out when plotting a downward movement of the plunger of the flow tester relative to the temperature.

[Glass Transition Temperature of Resin]

Using a differential scanning calorimeter "Q-20" available from TA Instruments Japan Inc., a sample was heated to 200° C. and then cooled from 200° C. to 0° C. at a temperature drop rate of 10° C./min, and further heated at temperature rise rate of 10° C./min to measure and prepare an endothermic characteristic curve thereof. Among the endothermic peaks observed in the characteristic curve, the temperature of the peak having a largest peak area was regarded as an endothermic maximum peak temperature. The temperature at which an extension of the baseline below the endothermic maximum peak temperature was intersected with a tangential line having a maximum inclination in the region from a rise-up portion to an apex of the peak in the curve was read as the glass transition temperature.

[Melting Point of Releasing Agent]

Using a differential scanning calorimeter "Q-20" available from TA Instruments Japan Inc., a sample was heated to 200° C. and then cooled from 200° C. to 0° C. at a temperature drop rate of 10° C./min, and further heated at temperature rise rate of 10° C./min to measure and prepare a characteristic curve of heat of fusion thereof. The maximum peak temperature of heat of fusion in the curve was regarded as a melting point of the sample.

[Volume Median Particle Sizes ($D_{50}$) and Particle Size Distribution (CV) of Resin Particles (A), Resin Particles (B) and Releasing Agent Particles]

(1) Measuring Apparatus: Laser diffraction particle size analyzer "LA-920" commercially available from HORIBA Ltd.

(2) Measuring Conditions: In a cell for the measurement which was filled with distilled water, a volume median particle size (DO and a volume average particle size of the particles was measured at a concentration at which an absorbance thereof was present within an adequate range. Also, the CV (particle size distribution) of the particles was calculated according to the following formula:

CV (%)=(Standard Deviation of Particle Size Distribution/Volume Average Particle Size)×100.

[Solid Contents of Dispersions of Resin Particles (A), Resin Particles (B) and Releasing Agent Particles]

Using an infrared moisture meter "FD-230" available from Kett Electric Laboratory, 5 g of a sample to be measured was subjected to measurement of a water content (% by mass) thereof at a drying temperature of 150° C. under a measuring mode 96 (monitoring time: 2.5 min/variation range: 0.05%). The solid content of the respective dispersions was calculated according to the following formula:

Solid Content (% by mass)=100−Water Content (% by mass).

[Volume Median Particle Sizes ($D_{50}$) and CV of Aggregated Particles (1) and Aggregated Particles (2)]

The volume median particle sizes ($D_{50}$) of the above aggregated particles were measured as follows.

Measuring Apparatus: "Coulter Multisizer III" commercially available from Beckman Coulter Inc.

Aperture Diameter: 50 μm

Analyzing Software: "Multisizer III Ver. 3.51" commercially available from Beckman Coulter Inc.

Electrolyte Solution: "Isotone II" commercially available from Beckman Coulter Inc.

Measuring Conditions:

The sample dispersion containing the aggregated particles was added to 100 mL of the electrolyte solution, and after controlling a concentration of the resultant dispersion so as to complete measurement for particle sizes of 30000 particles within 20 s, the particle sizes of the 30000 particles in the dispersion were measured under the condition, and the volume median particle size ($D_{50}$) and volume average particle size of the particles were determined from a particle size distribution thereof.

Also, CV (%) as the particle size distribution was calculated according to the following formula:

CV (%)=(Standard Deviation of Particle Size Distribution/Volume Average Particle Size)×100.

[Volume Median Particle Size ($D_{50}$) and CV of Toner Particles (Coalesced Particles)]

The volume median particle size of the toner particles (coalesced particles) was measured as follows.

The same measuring apparatus, aperture diameter, analyzing software and electrolyte solution as used for measuring the volume median particle size of the aggregated particles were used.

Dispersing Solution:

A polyoxyethylene lauryl ether "EMULGEN 109P" (HLB: 13.6) commercially available from Kao Corporation was dissolved in the above electrolyte solution to prepare a dispersing solution having a concentration of 5% by mass.

Dispersing Conditions:

Ten milligrams of a toner sample to be measured were added to 5 mL of the aforementioned dispersing solution, and dispersed therein using an ultrasonic disperser for 1 min. Thereafter, 25 mL of the electrolyte solution was added to the resulting dispersion, and the obtained mixture was further dispersed using the ultrasonic disperser for 1 min to prepare a sample dispersion.

Measuring Conditions:

The thus prepared sample dispersion was added to 100 mL of the electrolyte solution, and after controlling a concentration of the resultant dispersion so as to complete measurement for particle sizes of 30000 particles within 20 s, the particle sizes of the 30000 particles in the dispersion were measured under the condition, and the volume median particle size ($D_{50}$) and volume average particle size of the particles were determined from a particle size distribution thereof.

Also, CV (%) of the particles was calculated according to the following formula:

CV (%)=(Standard Deviation of Particle Size Distribution/Volume Average Particle Size)×100.

[Evaluation of Fusing Property of Toner]

A solid image was outputted and printed on a wood-free paper "J Paper A4 Size" available from Fuji Xerox Co., Ltd., using a commercially available printer "Microline 5400" available from Oki Data Corporation. The solid image thus outputted was an unfused solid image having a length of 50 mm which was printed on a region of the A4 paper except for its top margin extending 5 mm from a top edge thereof such that an amount of the toner deposited on the paper was from 0.42 to 0.48 mg/cm$^2$.

Next, the thus obtained unfused solid image on the paper was fused by passing the paper through the same printer equipped with a fuser that was modified so as to variably control its fusing temperature. Upon fusing the solid image, the temperature of the fuser was adjusted to 90° C., and the fusing speed of the solid image was adjusted to 1.5 s per sheet in a longitudinal direction of the A4 paper, thereby obtaining a printed paper.

In addition, the same fusing procedure was repeated while increasing the fusing temperature of the fuser at intervals of 5° C., thereby obtaining printed papers having a fused solid image.

A mending tape "Scotch Mending Tape 810" (width: 18 mm) available from 3M Japan Limited was cut into a length of 50 mm and lightly attached to a portion of the respective printed papers so as to extend from the top margin above an upper end of the solid image to the solid image-formed portion. Then, a weight of 500 g was rested on the tape and moved over the tape by one reciprocative motion at a speed of 10 mm/s while being kept in press-contact with the tape. Thereafter, the attached tape was peeled off from its lower end side at a peel angle of 180° and a peel speed of 10 mm/s, thereby obtaining the printed papers from which the tape had been peeled off. Before attaching the tape to the printed paper and after peeling-off the tape therefrom, each of the printed papers was placed on 30 sheets of a wood-free paper "EXCELLENT WHITE PAPER A4 Size" available from Oki Data Corporation to measure a reflection image density of the fused image portion thereof using a colorimeter "SpectroEye" available from GretagMacbeth GmbH under the light irradiating conditions including a standard light source $D_{50}$, an observation visual field of 2°, and a density standard DINNB based on an absolute white color. The fusing rate of the toner images was calculated from the thus measured reflection image density values according to the following formula.

Fusing Rate (%)=(Reflection Image Density after Peeling-off Tape/Reflection Image Density before Attaching Tape)×100

While raising the fusing temperature of the fuser at intervals of 5° C., the aforementioned test was conducted at the respective fusing temperatures at intervals of 5° C. until reaching the temperature at which cold offset was caused, or hot offset was caused via the temperature at which the fusing rate became less than 90%.

Meanwhile, the "cold offset" as used herein means such a phenomenon that in the case where the temperature of the fuser is low, the toner in the unfused toner images fails to be sufficiently melted and is therefore deposited onto a fusing roller. Whereas, the "hot offset" as used herein means such a phenomenon that in the case where the temperature of the fuser is high, the toner is deposited on the fusing roller. The occurrence of the cold offset or hot offset may be determined by examining whether or not the toner is deposited again on the paper upon rotating the fusing roller by one revolution. In the present test, in the case where the solid image on the paper suffered from peeling, it was determined that the cold offset occurred, whereas in the case where the toner deposited on the fusing roller was attached on a portion of the paper located 87 mm from an upper end of the solid image, it was determined that the hot offset occurred.

The lowest temperature among temperatures at which no cold offset occurred and the fusing rate was not less than 90% was defined as a lowest fusing temperature of the toner, and the temperature range from the lowest fusing temperature to the temperature lower by 5° C. than the temperature at which the hot offset occurred was defined as a fusable temperature range (hereinafter also referred to as a "fusing range"). The wider the fusable temperature range, the more excellent the fusing property of the toner.

[Evaluation of Durability of Toner]

The toner was charged into a developing cartridge of a non-magnetic one-component developing device "Microline 5400" available from Oki Data Corporation. The developing device was idled at 70 rpm (corresponding to a printing speed of 36 ppm model) at a temperature of 25° C. and a humidity of 65% to visually observe whether or not any streaks or unevenness occurred, and measure the time elapsed until the occurrence of streaks or unevenness. The durability of the toner was evaluated by the thus measured time.

In the one-component developing device, the toner is electrostatically charged by passing through a blade portion thereof. In this case, in the case where the toner is mechanically and physically weak against external factors, deposition of the toner on the blade portion or developing roll occurs, and the deposited toner is observed as unevenness. Therefore, as the time elapsed until the occurrence of unevenness is increased, the toner is more excellent in durability.

[Evaluation of Toner Cloud]

The following procedures all were carried out at room temperature (25° C.) and a relative humidity of 50% RH. First, 0.7 g of a toner and 9.3 g of a silicone ferrite carrier (available from Kanto Denka Kogyo Co., Ltd.; average particle size: 40 μm) were charged into a 20 mL-capacity cylindrical polypropylene bottle available from Nikko Hansen & Co., Ltd., and stirred by shaking 10 times in each of vertical and horizontal directions. Thereafter, the resulting mixture was stirred by a ball mill for 10 min.

A developing roller (diameter: 42 mm) was dismounted from a commercially available printer "Microline 5400" available from Oki Data Corporation and modified so as to rotate at a variable speed, thereby obtaining an external developing roller device. The developing roller of the external developing roller device was rotated at 10 revolutions per minute, and a developer (mixture of the toner and the silicone ferrite carrier) was attached onto the developing roller. After uniformly attaching the developer over the developing roller, the developing roller was temporarily stopped. Then, the rotating speed of the developing roller was changed to 45 revolutions per minute to measure the number of toner particles scattered around when rotating the developer roller for 1 min using a digital dust meter "Model P-5" available from Shibata Science Technology Ltd.

The toner cloud was evaluated by the number of the toner particles scattered. As the number of the toner particles scattered is reduced, the occurrence of toner cloud is more effectively suppressed.

Production Example 1

Production of Polyester A

An inside atmosphere of a four-necked flask equipped with a nitrogen inlet tube, a dehydration tube, a stirrer and a thermocouple was replaced with nitrogen, and 3,374 g of polyoxypropylene (2.2)-2,2-bis(4-hydroxyphenyl)propane, 33 g of polyoxyethylene (2.0)-2,2-bis(4-hydroxyphenyl) propane, 672 g of terephthalic acid and 10 g of dibutyl tin oxide were charged into the flask. The contents of the flask were heated to 230° C. in a nitrogen atmosphere while stirring and held at 230° C. for 5 h, and then the pressure within the flask was reduced and held under 8.3 kPa for 1 h. Thereafter, the contents of the flask were cooled to 210° C. The pressure within the flask was returned to atmospheric pressure, and then 696 g of fumaric acid and 0.49 g of tert-butyl catechol were added to the flask. The contents of the flask were held at 210° C. for 5 h, and then the pressure within the flask was reduced and held under 8.3 kPa for 4 h, thereby obtaining a polyester A. The properties of the thus obtained polyester A are shown in Table 1.

Production Example 2

Production of Polyester B

An inside atmosphere of a four-necked flask equipped with a nitrogen inlet tube, a dehydration tube, a stirrer and a thermocouple was replaced with nitrogen, and 1,750 g of polyoxypropylene (2.2)-2,2-bis(4-hydroxyphenyl)propane, 1,625 g of polyoxyethylene (2.0)-2,2-bis(4-hydroxyphenyl) propane, 1,145 g of terephthalic acid, 161 g of dodecenylsuccinic anhydride, 480 g of trimellitic anhydride and 10 g of dibutyl tin oxide were charged into the flask. The contents of the flask were heated to 220° C. in a nitrogen atmosphere while stirring and held at 220° C. for 5 h. Thereafter, after confirming that the softening point of the contents of the flask reached 120° C. as measured according to ASTM D36-86, the contents of the flask were cooled to terminate a reaction thereof, thereby obtaining a polyester B. The properties of the thus obtained polyester B are shown in Table 1.

Production Example 3

Production of Polyester C

An inside atmosphere of a four-necked flask equipped with a nitrogen inlet tube, a dehydration tube, a stirrer and a thermocouple was replaced with nitrogen, and 3,325 g of polyoxypropylene (2.2)-2,2-bis(4-hydroxyphenyl)propane, 978 g of terephthalic acid and 23 g of tin di(2-ethyl hexanoate) were charged into the flask. The contents of the flask were heated to 230° C. in a nitrogen atmosphere while stirring and held at 230° C. for 5 h, and then the pressure within the flask was reduced and held under 8.3 kPa for 1 h. Thereafter, the contents of the flask were cooled to 210° C. The pressure within the flask was returned to atmospheric pressure, and then 419 g of fumaric acid and 0.49 g of tert-butyl catechol were added to the flask. The contents of the flask were held at 210° C. for 5 h, and then the pressure within the flask was reduced and held under 8.3 kPa for 4 h, thereby obtaining a polyester C. The properties of the thus obtained polyester C are shown in Table 1.

Production Example 4

Production of Polyester D

An inside atmosphere of a four-necked flask equipped with a nitrogen inlet tube, a dehydration tube, a stirrer and a thermocouple was replaced with nitrogen, and 3,004 g of polyoxypropylene (2.2)-2,2-bis(4-hydroxyphenyl)propane, 996 g of fumaric acid, 2 g of tert-butyl catechol and 8 g of dibutyl tin oxide were charged into the flask. The contents of the flask were heated to 210° C. over 5 h in a nitrogen atmosphere while stirring and held at 210° C. for 2 h. Thereafter, the contents of the flask were reacted under 8.3 kPa until the softening point thereof reached 100° C., thereby obtaining a polyester D. The properties of the thus obtained polyester D are shown in Table 1.

Production Example 5

Production of Polyester E

An inside atmosphere of a four-necked flask equipped with a nitrogen inlet tube, a dehydration tube, a stirrer and a thermocouple was replaced with nitrogen, and 4,410 g of polyoxypropylene (2.2)-2,2-bis(4-hydroxyphenyl)propane, 1,755 g of polyoxyethylene (2.0)-2,2-bis(4-hydroxyphenyl) propane, 1,712 g of fumaric acid, 4 g of tert-butyl catechol, 622 g of trimellitic anhydride and 16 g of dibutyl tin oxide were charged into the flask. The contents of the flask were heated to 210° C. over 5 h in a nitrogen atmosphere while stirring and held at 210° C. for 2 h, thereby obtaining a polyester E. The properties of the thus obtained polyester E are shown in Table 1.

Production Example 6

Production of Polyester F

An inside atmosphere of a four-necked flask equipped with a nitrogen inlet tube, a dehydration tube, a stirrer and a thermocouple was replaced with nitrogen, and 4,655 g of polyoxypropylene (2.2)-2,2-bis(4-hydroxyphenyl)propane, 1,853 g of polyoxyethylene (2.0)-2,2-bis(4-hydroxyphenyl) propane, 277 g of adipic acid, 1,984 g of fumaric acid, 4 g of tert-butyl catechol and 44 g of tin di(2-ethyl hexanoate) were charged into the flask. The contents of the flask were heated to 210° C. over 5 h in a nitrogen atmosphere while stirring and held at 210° C. for 2 h. Thereafter, the contents of the flask were reacted under 8.3 kPa until the softening point thereof reached 90° C., thereby obtaining a polyester F. The properties of the thus obtained polyester F are shown in Table 1.

Production Example 7

Production of Polyester G

An inside atmosphere of a four-necked flask equipped with a nitrogen inlet tube, a dehydration tube, a stirrer and a thermocouple was replaced with nitrogen, and 5,670 g of polyoxypropylene (2.2)-2,2-bis(4-hydroxyphenyl)propane, 585 g of polyoxyethylene (2.0)-2,2-bis(4-hydroxyphenyl) propane, 2,450 g of terephthalic acid and 44 g of tin di(2-ethyl hexanoate) were charged into the flask. The contents of the flask were heated to 235° C. in a nitrogen atmosphere while stirring and held at 235° C. for 5 h, and then the pressure within the flask was reduced and held under 8.0 kPa for 1 h. After the pressure within the flask was returned to atmospheric pressure, the contents of the flask were cooled to 190° C., and then 42 g of fumaric acid and 207 g of trimellitic acid were added to the flask. The contents of the flask were held at 190° C. for 2 h, and then heated to 210° C. over 2 h. Further, the pressure within the flask was reduced and held under 8.0 kPa for 4 h, thereby obtaining a polyester G. The properties of the thus obtained polyester G are shown in Table 1.

Production Example 8

Production of Polyester H

An inside atmosphere of a four-necked flask equipped with a nitrogen inlet tube, a dehydration tube, a stirrer and a thermocouple was replaced with nitrogen, and 3,465 g of polyoxypropylene (2.2)-2,2-bis(4-hydroxyphenyl)propane, 33 g of polyoxyethylene (2.0)-2,2-bis(4-hydroxyphenyl) propane, 1,434 g of terephthalic acid and 9 g of dibutyl tin oxide were charged into the flask. The contents of the flask were heated to 230° C. in a nitrogen atmosphere while stirring and held at 230° C. for 5 h, and then the pressure within the flask was reduced and held under 8.3 kPa for 4 h, thereby obtaining a polyester H. The properties of the thus obtained polyester H are shown in Table 1.

TABLE 1

| | Production Example 1 Polyester A | Production Example 2 Polyester B | Production Example 3 Polyester C | Production Example 4 Polyester D |
|---|---|---|---|---|
| Raw material monomers | | | | |
| Alcohol component | | | | |
| BPA-PO*[1] | 3374 g(99) | 1750 g(50) | 3325 g(100) | 3004 g (100) |
| BPA-EO*[2] | 33 g(1) | 1625 g(50) | — | — |
| Acid component | | | | |
| Aliphatic carboxylic acid component | | | | |
| Fumaric acid | 696 g (62) | — | 419 g (38) | 996 g (100) |
| Dodecenylsuccinic anhydride | — | 161 g (6) | — | — |
| Adipic acid | — | — | — | — |
| Aromatic carboxylic acid component | | | | |
| Terephthalic acid | 672 g (42) | 1145 g (69) | 978 g (62) | — |
| Trimellitic anhydride | — | 480 g (25) | — | — |
| Content of aliphatic carboxylic acid component in acid component (% by mass) | 51 | 9.0 | 30 | 100 |
| Esterification catalyst | | | | |
| Dibutyl tin oxide | 10 g | 10 g | — | 8 g |
| Tin di(2-ethyl hexanoate) | — | — | 23 g | — |
| Polymerization inhibitor | | | | |
| tert-Butyl catechol | 0.49 g | — | 0.49 g | 2 g |
| Properties of resin | | | | |
| Softening point (° C.) | 107 | 122 | 105 | 100 |
| Glass transition temperature (° C.) | 65 | 64 | 66 | 60 |
| Acid value (mgKOH/g) | 24 | 21 | 25 | 21 |

| | Production Example 5 Polyester E | Production Example 6 Polyester F | Production Example 7 Polyester G | Production Example 8 Polyester H |
|---|---|---|---|---|
| Raw material monomers | | | | |
| Alcohol component | | | | |
| BPA-PO*[1] | 4410 g (70) | 4655 g (70) | 5670 g (90) | 3465 g (99) |
| BPA-EO*[2] | 1755 g (30) | 1853 g (30) | 585 g (10) | 33 g (1) |
| Acid component | | | | |
| Aliphatic carboxylic acid component | | | | |
| Fumaric acid | 1712 g (82) | 1984 g (90) | 42 g (2) | — |
| Dodecenylsuccinic anhydride | — | — | — | — |
| Adipic acid | — | 277 g (10) | — | — |
| Aromatic carboxylic acid component | | | | |
| Terephthalic acid | — | — | 2450 g (82) | 1434 g (86) |
| Trimellitic anhydride | 622 g (18) | — | 207 g (6) | — |
| Content of aliphatic carboxylic acid component in acid component (% by mass) | 73 | 100 | 1.6 | 0 |
| Esterification catalyst | | | | |
| Dibutyl tin oxide | 16 g | — | — | 9 g |
| Tin di(2-ethyl hexanoate) | — | 44 g | 44 g | — |
| Polymerization inhibitor | | | | |
| tert-Butyl catechol | 4 g | 4 g | — | — |
| Properties of resin | | | | |
| Softening point (° C.) | 89 | 92 | 106 | 101 |
| Glass transition temperature (° C.) | 51 | 51 | 67 | 62 |
| Acid value (mgKOH/g) | 28 | 15 | 19 | 11 |

Note:

Numerical values in parentheses each indicate a molar number based on 100 mol of a total amount of alcohol component.

[1]*Polyoxypropylene (2.2)-2,2-bis(4-hydroxyphenyl)propane; and

[2]*Polyoxyethylene (2.0)-2,2-bis(4-hydroxyphenyl)propane

Production of Resin Particle Dispersions

Production Example 9

Production of Resin Particle Dispersion A-1

A 2 L-capacity stainless steel vessel was charged with 510.0 g of the polyester A, 90.0 g of the polyester B, 40.0 g of a 15% by mass sodium dodecylbenzenesulfonate aqueous solution "NEOPELEX G-15" (anionic surfactant) available from Kao Corporation, 6.0 g of polyoxyethylene oleyl ether "EMULGEN 430" (nonionic surfactant; HLB: 16.2) available from Kao Corporation, and 278.5 g of a 5% by mass potassium hydroxide aqueous solution, and the contents of the vessel were dispersed at 95° C. while stirring with a paddle-shaped stirrer at 200 r/min (peripheral speed: 1.2 m/s). Further, the contents of the vessel were maintained for 2 h while stirring with a paddle-shaped stirrer at 200 r/min (peripheral speed: 1.2 m/s). Subsequently, while stirring the contents of the vessel with a paddle-shaped stirrer at 200 r/min (peripheral speed: 1.2 m/s), 1,212 g of deionized water was added dropwise thereto at a rate of 6 g/min. In addition, the temperature of the reaction system was held at 95° C.

After completion of the dropwise addition, the resulting reaction mixture was cooled and then allowed to pass through a wire mesh having a 200 mesh screen (opening size: 105 μm), thereby obtaining a resin particle dispersion A-1 containing fine grained resin particles. As a result, it was confirmed that the resin particles contained in the thus obtained resin particle dispersion A-1 had a volume median particle size ($D_{50}$) of 0.12 μm and CV of 24%, and the resin particle dispersion A-1 had a solid content of 30% by mass.

Production Examples 10 to 17

Production of Resin Particle Dispersions A-2 to A-9

The same procedure as in Production Example 9 (the method for production of A-1) was repeated except that the amounts of the polyesters A and B used were respectively changed as shown in Table 2, thereby obtaining resin particle dispersions.

Production Example 18

Production of Resin Particle Dispersion B-1

A 2 L-capacity stainless steel vessel was charged with 510.0 g of the polyester A, 90.0 g of the polyester B, 45 g of a copper phthalocyanine pigment "ECB-301" available from Dai-Nichi Seika Color & Chemicals Mfg. Co., Ltd., 40.0 g of a 15% by mass sodium dodecylbenzenesulfonate aqueous solution "NEOPELEX G-15" (anionic surfactant) available from Kao Corporation, 6.0 g of polyoxyethylene oleyl ether "EMULGEN 430" (nonionic surfactant; HLB: 16.2) available from Kao Corporation, and 278.5 g of a 5% by mass potassium hydroxide aqueous solution, and the contents of the vessel were dispersed at 95° C. while stirring with a paddle-shaped stirrer at 200 r/min (peripheral speed: 1.2 m/s). Further, the contents of the vessel were maintained for 2 h while stirring with a paddle-shaped stirrer at 200 r/min (peripheral speed: 1.2 m/s). Subsequently, while stirring the contents of the vessel with a paddle-shaped stirrer at 200 r/min (peripheral speed: 1.2 m/s), 1,222 g of deionized water was added dropwise thereto at a rate of 6 g/min. In addition, the temperature of the reaction system was held at 95° C. After completion of the dropwise addition, the contents of the vessel were cooled to 25° C. While stirring the contents of the vessel with a paddle-shaped stirrer at 200 r/min (peripheral speed: 1.2 m/s), 28 g of an oxazoline group-containing polymer aqueous solution "EPOCROS WS-700" (non-volatile content: 25% by mass) available from Nippon Shokubai Co., Ltd., was added thereto. Thereafter, the contents of the vessel were heated to 95° C., and held at 95° C. for 1 h.

The resulting reaction mixture was cooled and then allowed to pass through a wire mesh having a 200 mesh screen (opening size: 105 μm), thereby obtaining a resin particle dispersion B-1 containing fine grained resin particles. As a result, it was confirmed that the resin particles contained in the thus obtained resin particle dispersion B-1 had a volume median particle size ($D_{50}$) of 0.14 μm and CV of 25%, and the resin particle dispersion B-1 had a solid content of 31% by mass.

TABLE 2

| | Production Example 9 | Production Example 10 | Production Example 11 | Production Example 12 | Production Example 13 | Production Example 14 | Production Example 15 | Production Example 16 | Production Example 17 |
|---|---|---|---|---|---|---|---|---|---|
| Resin particle dispersion | A-1 | A-2 | A-3 | A-4 | A-5 | A-6 | A-7 | A-8 | A-9 |
| Polyester | A (85)<br>B (15) | A (100)<br>— | C (100)<br>— | F (100)<br>— | G (100)<br>— | A (65)<br>E (35) | C (65)<br>G (35) | C (15)<br>E (85) | H (100)<br>— |
| Content of aliphatic carboxylic acid component in acid component constituting polyester in resin particles (% by mass) | 45 | 51 | 30 | 100 | 1.6 | 59 | 20 | 67 | 0 |
| Volume median particle size $D_{50}$ of resin particles (μm) | 0.12 | 0.11 | 0.10 | 0.11 | 0.10 | 0.15 | 0.16 | 0.14 | 0.76 |
| CV of resin particles (%) | 24 | 23 | 23 | 24 | 23 | 26 | 26 | 25 | 36 |
| Solid content of resin particle dispersion (% by mass) | 30 | 30 | 30 | 30 | 30 | 30 | 30 | 30 | 29 |

Note:
Numerical values in parentheses each indicate a mass ratio.

Production Examples 19 to 21

Production of Resin Particle Dispersions B-2 to B-4

The same procedure as in Production Example 18 (the method for production of B-1) was repeated except that the amounts of the polyesters A and B used were respectively changed as shown in Table 3, thereby obtaining resin particle dispersions.

TABLE 3

| | Production Example 18 | Production Example 19 | Production Example 20 | Production Example 21 |
|---|---|---|---|---|
| Resin particle dispersion | B-1 | B-2 | B-3 | B-4 |
| Polyester | A (85)<br>B (15) | D (65)<br>E (35) | B (35)<br>G (65) | H (100)<br>— |
| Content of aliphatic carboxylic acid component in acid component constituting polyester in resin particles (% by mass) | 45 | 91 | 4 | 0 |
| Volume median particle size $D_{50}$ of resin particles (μm) | 0.14 | 0.12 | 0.14 | 0.84 |
| CV of resin particles (%) | 25 | 24 | 23 | 38 |
| Solid content of resin particle dispersion (% by mass) | 31 | 31 | 31 | 29 |

Note:
Numerical values in parentheses each indicate a mass ratio.

Production of Releasing Agent Particle Dispersions

Production Example 22

Production of Releasing Agent Particle Dispersion W-1

A 1 L-capacity beaker was charged with 225 g of deionized water, 5 g of a carnauba wax "Carnauba Wax #1" (melting point: 83° C.) available from S. Kato & Co., and 45 g of a paraffin wax "HNP-9" (melting point: 75° C.) available from Nippon Seiro Co., Ltd., and the contents of the beaker were maintained at a temperature of 90 to 95° C. for melting, and then stirred, thereby obtaining a molten mixture in which the carnauba wax and paraffin wax were integrally melted together. Then, 1.7 g of an oxazoline group-containing polymer aqueous solution "EPOCROS WS-700" (nonvolatile content: 25% by mass) available from Nippon Shokubai Co., Ltd., was added to the beaker, and while maintaining the resulting reaction mixture at a temperature of 90 to 95° C., the reaction mixture was subjected to dispersing treatment for 15 min using an ultrasonic homogenizer "US-600T" available from Nihonseiki Kaisha Ltd. In addition, 14 g of the resin particle dispersion A-1 was added to the resulting dispersion, and the obtained mixture was subjected to dispersing treatment for 15 min using the same ultrasonic homogenizer, and then cooled to room temperature. Then, deionized water was added to the resulting dispersion to adjust a solid content of the dispersion to 20% by mass, thereby obtaining a releasing agent particle dispersion W-1. As a result, it was confirmed that the releasing agent particles contained in the resulting releasing agent particle dispersion W-1 had a volume median particle size ($D_{50}$) of 0.53 μm and CV of 35%. The properties of the thus obtained releasing agent particle dispersion W-1 are shown in Table 4-1.

Production Examples 23 to 29 and 35

Production of Releasing Agent Particle Dispersions W-2 to W-8 and W-14

The same procedure as in Production Example 22 (the method for production of W-1) was repeated except that the resin particle dispersion A-1 was replaced with the respective resin particle dispersions shown in Tables 4-1 and 4-2, thereby obtaining releasing agent particle dispersions.

Production Example 30

Production of Releasing Agent Particle Dispersion W-9

The same procedure as in Production Example 22 (the method for production of W-1) was repeated except that the paraffin wax "HNP-9" was replaced with a paraffin wax "HNP-11" (melting point: 68° C.) available from Nippon Seiro Co., Ltd., thereby obtaining a releasing agent particle dispersion W-9.

Production Example 31

Production of Releasing Agent Particle Dispersion W-10

The same procedure as in Production Example 22 (the method for production of W-1) was repeated except that 1.7 g of the oxazoline group-containing polymer aqueous solution "EPOCROS WS-700" was replaced with 1.7 g of a 25% by mass aqueous solution of polyglycerol polyglycidyl ether prepared by dissolving "DENACOL EX-521" in deionized water, thereby obtaining a releasing agent particle dispersion W-10.

Production Example 32

Production of Releasing Agent Particle Dispersion W-11

The same procedure as in Production Example 22 (the method for production of W-1) was repeated except that no oxazoline group-containing polymer aqueous solution "EPOCROS WS-700" was used, thereby obtaining a releasing agent particle dispersion W-11.

Production Example 33

Production of Releasing Agent Particle Dispersion W-12

In a 1 L-capacity beaker, 6.7 g of a 15% by mass sodium dodecylbenzenesulfonate aqueous solution "NEOPELEX G-15" (anionic surfactant) available from Kao Corporation was dissolved in 400 g of deionized water, and then 58 g of a carnauba wax "Carnauba Wax #1" (melting point: 83° C.) available from S. Kato & Co., and 42 g of a paraffin wax "HNP-9" (melting point: 75° C.) available from Nippon Seiro Co., Ltd., were added and dispersed in the resulting solution. While maintaining the resulting dispersion at a temperature of 90 to 95° C., the dispersion was subjected to dispersing treatment for 30 min using an ultrasonic homogenizer "US-600T" available from Nippon Seiki Co., Ltd., and then cooled to room temperature. Then, deionized water was added to the resulting dispersion to adjust a solid content of the dispersion to 20% by mass, thereby obtaining a releasing agent particle dispersion W-12.

Production Example 34

Production of Releasing Agent Particle Dispersion W-13

The same procedure as in Production Example 32 (the method for production of W-11) was repeated except that 14 g of the resin particle dispersion A-1 was replaced with 10 g of a commercially available styrene-acrylic resin emulsion (solid content: 42% by mass) available from Nippon Shokubai Co., Ltd., thereby obtaining a releasing agent particle dispersion W-13.

The volume median particle size and CV of the releasing agent particles contained in each of the thus obtained releasing agent particle dispersions W-1 to W-14 are shown in Table 4-1 and Table 4-2.

TABLE 4-1

| | Production Example 22 | Production Example 23 | Production Example 24 | Production Example 25 |
|---|---|---|---|---|
| Releasing agent particle dispersion | W-1 | W-2 | W-3 | W-4 |
| Components (g) | | | | |
| Wax | | | | |
| Carnauba wax | 5 | 5 | 5 | 5 |
| Paraffin wax "HNP-9" | 45 | 45 | 45 | 45 |
| Paraffin wax "HNP-11" | — | — | — | — |
| Oxazoline group-containing polymer aqueous solution (solid content: 25% by mass) | 1.7 | 1.7 | 1.7 | 1.7 |
| Polyglycerol polyglycidyl ether aqueous solution (solid content: 25% by mass) | — | — | — | — |
| Resin particle dispersion | | | | |
| A-1 (solid content: 30% by mass) | 14 | — | — | — |
| A-2 (solid content: 30% by mass) | — | 14 | — | — |
| A-3 (solid content: 30% by mass) | — | — | 14 | — |
| A-4 (solid content: 30% by mass) | — | — | — | 14 |
| A-5 (solid content: 30% by mass) | — | — | — | — |
| A-6 (solid content: 30% by mass) | — | — | — | — |
| A-7 (solid content: 30% by mass) | — | — | — | — |
| A-8 (solid content: 30% by mass) | — | — | — | — |
| A-9 (solid content: 30% by mass) | — | — | — | — |
| Styrene-acrylic resin emulsion (solid content: 42% by mass) | — | — | — | — |
| Surfactant | | | | |
| Sodium dodecylbenzenesulfonate (solid content: 15% by mass) | — | — | — | — |
| Content $S_A$ of aliphatic carboxylic acid component in acid component constituting polyester contained in resin particles (A) (% by mass) | 45 | 51 | 30 | 100 |
| Amount of surfactant based on 100 parts by mass of releasing agent (part(s) by mass)*1 | 0.16 | 0.16 | 0.16 | 0.16 |
| Wax/resin particles (mass ratio) | 50/4.2 | 50/4.2 | 50/4.2 | 50/4.2 |
| Volume median particle size ($D_{50}$) of releasing agent particles (μm) | 0.53 | 0.50 | 0.58 | 0.61 |
| CV of releasing agent particles (%) | 35 | 36 | 36 | 33 |
| Solid content of releasing agent particle dispersion (% by mass) | 20 | 20 | 20 | 20 |

TABLE 4-1-continued

| | Production Example 26 | Production Example 27 | Production Example 28 |
|---|---|---|---|
| Releasing agent particle dispersion | W-5 | W-6 | W-7 |
| Components (g) | | | |
| Wax | | | |
| Carnauba wax | 5 | 5 | 5 |
| Paraffin wax "HNP-9" | 45 | 45 | 45 |
| Paraffin wax "HNP-11" | — | — | — |
| Oxazoline group-containing polymer aqueous solution (solid content: 25% by mass) | 1.7 | 1.7 | 1.7 |
| Polyglycerol polyglycidyl ether aqueous solution (solid content: 25% by mass) | — | — | — |
| Resin particle dispersion | | | |
| A-1 (solid content: 30% by mass) | — | — | — |
| A-2 (solid content: 30% by mass) | — | — | — |
| A-3 (solid content: 30% by mass) | — | — | — |
| A-4 (solid content: 30% by mass) | — | — | — |
| A-5 (solid content: 30% by mass) | 14 | — | — |
| A-6 (solid content: 30% by mass) | — | 14 | — |
| A-7 (solid content: 30% by mass) | — | — | 14 |
| A-8 (solid content: 30% by mass) | — | — | — |
| A-9 (solid content: 30% by mass) | — | — | — |
| Styrene-acrylic resin emulsion (solid content: 42% by mass) | — | — | — |
| Surfactant | | | |
| Sodium dodecylbenzenesulfonate (solid content: 15% by mass) | — | — | — |
| Content $S_A$ of aliphatic carboxylic acid component in acid component constituting polyester contained in resin particles (A) (% by mass) | 1.6 | 59 | 20 |
| Amount of surfactant based on 100 parts by mass of releasing agent (part(s) by mass)*[1] | 0.16 | 0.16 | 0.16 |
| Wax/resin particles (mass ratio) | 50/4.2 | 50/4.2 | 50/4.2 |
| Volume median particle size ($D_{50}$) of releasing agent particles (μm) | 0.59 | 0.52 | 0.54 |
| CV of releasing agent particles (%) | 35 | 37 | 35 |
| Solid content of releasing agent particle dispersion (% by mass) | 20 | 20 | 20 |

Note:
*[1]Inclusive of amount of surfactant derived from resin particle dispersion.
Carnauba wax (melting point: 83° C.) available from S. Kato & Co.;
Paraffin wax "HNP-9" (melting point: 75° C.) available from Nippon Seiro Co., Ltd.;
Paraffin wax "HNP-11" (melting point: 68° C.) available from Nippon Seiro Co., Ltd.;
Oxazoline group-containing polymer aqueous solution (solid content: 25% by mass) "EPOCROS WS-700" available from Nippon Shokubai Co., Ltd.;
Polyglycerol polyglycidyl ether aqueous solution (solid content: 25% by mass) "DENACOL EX-521" available from Nagase ChemteX Corporation; and
Styrene-acrylic resin emulsion (solid content: 42% by mass) available from Nippon Shokubai Co., Ltd.

TABLE 4-2

| | Production Example 29 | Production Example 30 | Production Example 31 | Production Example 32 |
|---|---|---|---|---|
| Releasing agent particle dispersion | W-8 | W-9 | W-10 | W-11 |
| Components (g) | | | | |
| Wax | | | | |
| Carnauba wax | 5 | 5 | 5 | 5 |
| Paraffin wax "HNP-9" | 45 | — | 45 | 45 |
| Paraffin wax "HNP-11" | — | 45 | — | — |
| Oxazoline group-containing polymer aqueous solution (solid content: 25% by mass) | — | 1.7 | — | — |
| Polyglycerol polyglycidyl ether aqueous solution (solid content: 25% by mass) | — | — | 1.7 | — |

TABLE 4-2-continued

| | | | | |
|---|---|---|---|---|
| Resin particle dispersion | | | | |
| A-1 (solid content: 30% by mass) | — | 14 | 14 | 14 |
| A-2 (solid content: 30% by mass) | — | — | — | — |
| A-3 (solid content: 30% by mass) | — | — | — | — |
| A-4 (solid content: 30% by mass) | — | — | — | — |
| A-5 (solid content: 30% by mass) | — | — | — | — |
| A-6 (solid content: 30% by mass) | — | — | — | — |
| A-7 (solid content: 30% by mass) | — | — | — | — |
| A-8 (solid content: 30% by mass) | 14 | — | — | — |
| A-9 (solid content: 30% by mass) | — | — | — | — |
| Styrene-acrylic resin emulsion (solid content: 42% by mass) | — | — | — | — |
| Surfactant | | | | |
| Sodium dodecylbenzenesulfonate (solid content: 15% by mass) | — | — | — | — |
| Content $S_A$ of aliphatic carboxylic acid component in acid component constituting polyester contained in resin particles (A) (% by mass) | 67 | 45 | 45 | 45 |
| Amount of surfactant based on 100 parts by mass of releasing agent (part(s) by mass)*1 | 0.16 | 0.16 | 0.16 | 0.16 |
| Wax/resin particles (mass ratio) | 50/4.2 | 50/4.2 | 50/4.2 | 50/4.2 |
| Volume median particle size ($D_{50}$) of releasing agent particles (μm) | 0.66 | 0.48 | 0.62 | 0.62 |
| CV of releasing agent particles (%) | 35 | 32 | 34 | 36 |
| Solid content of releasing agent particle dispersion (% by mass) | 20 | 20 | 20 | 20 |

| | Production Example 33 | Production Example 34 | Production Example 35 |
|---|---|---|---|
| Releasing agent particle dispersion | W-12 | W-13 | W-14 |
| Components (g) | | | |
| Wax | | | |
| Carnauba wax | 58 | 5 | 5 |
| Paraffin wax "HNP-9" | 42 | 45 | 45 |
| Paraffin wax "HNP-11" | — | — | — |
| Oxazoline group-containing polymer aqueous solution (solid content: 25% by mass) | — | — | 1.7 |
| Polyglycerol polyglycidyl ether aqueous solution (solid content: 25% by mass) | — | — | — |
| Resin particle dispersion | | | |
| A-1 (solid content: 30% by mass) | — | — | — |
| A-2 (solid content: 30% by mass) | — | — | — |
| A-3 (solid content: 30% by mass) | — | — | — |
| A-4 (solid content: 30% by mass) | — | — | — |
| A-5 (solid content: 30% by mass) | — | — | — |
| A-6 (solid content: 30% by mass) | — | — | — |
| A-7 (solid content: 30% by mass) | — | — | — |
| A-8 (solid content: 30% by mass) | — | — | — |
| A-9 (solid content: 30% by mass) | — | — | 14 |
| Styrene-acrylic resin emulsion (solid content: 42% by mass) | — | 10 | — |
| Surfactant | | | |
| Sodium dodecylbenzenesulfonate (solid content: 15% by mass) | 6.7 | — | — |
| Content $S_A$ of aliphatic carboxylic acid component in acid component constituting polyester contained in resin particles (A) (% by mass) | — | — | 0 |
| Amount of surfactant based on 100 parts by mass of releasing agent (part(s) by mass)*1 | 1.0 | — | 0.16 |
| Wax/resin particles (mass ratio) | — | 50/4.2 | 50/4.2 |
| Volume median particle size ($D_{50}$) of releasing agent particles (μm) | 0.45 | 0.65 | 1.09 |

TABLE 4-2-continued

| | | | |
|---|---|---|---|
| CV of releasing agent particles (%) | 30 | 36 | 40 |
| Solid content of releasing agent particle dispersion (% by mass) | 20 | 20 | 20 |

Note:
*[1]Inclusive of amount of surfactant derived from resin particle dispersion
Carnauba wax (melting point: 83° C.) available from S. Kato & Co.;
Paraffin wax "HNP-9" (melting point: 75° C.) available from Nippon Seiro Co., Ltd.;
Paraffin wax "HNP-11" (melting point: 68° C.) available from Nippon Seiro Co., Ltd.;
Oxazoline group-containing polymer aqueous solution (solid content: 25% by mass) "EPOCROS WS-700" available from Nippon Shokubai Co., Ltd.;
Polyglycerol polyglycidyl ether aqueous solution (solid content: 25% by mass) "DENACOL EX-521" available from Nagase ChemteX Corporation;
and Styrene-acrylic resin emulsion (solid content: 42% by mass) available from Nippon Shokubai Co., Ltd.

Example 1

Production of Toner 1

A 2 L-capacity four-necked flask equipped with a dehydration tube, a stirrer and a thermocouple was charged with 250 g of the resin particle dispersion B-1, 58 g of deionized water and 41 g of the releasing agent particle dispersion W-1, and the contents of the flask were mixed with each other at 25° C. Then, while stirring the resulting mixture with a paddle-shaped stirrer, an aqueous solution prepared by dissolving 18.2 g of ammonium sulfate in 162 g of deionized water was added dropwise to the mixture at 25° C. over 30 min. Next, the resulting mixed solution was heated to 55° C. and held at 55° C., thereby obtaining aggregated particles (1) having a volume median particle size ($D_{50}$) of 4.7 μm.

Subsequently, as a dispersion of the resin particles (B), a mixed solution prepared by mixing 25 g of the resin particle dispersion B-1 and 5.8 g of deionized water was added dropwise to the thus obtained aggregated particles (1) over 60 min. The aforementioned procedure for the dropwise addition of the mixed solution was repeated three times in total, thereby obtaining a dispersion of aggregated particles (2) having a volume median particle size ($D_{50}$) of 5.1 μm.

An aqueous solution prepared by diluting 11.6 g of sodium polyoxyethylenelaurylethersulfate "EMAL E-27C" (solid content: 28% by mass) available from Kao Corporation with 450 g of deionized water was added to the thus obtained dispersion of the aggregated particles (2). Then, the resulting dispersion was heated to 80° C. over 2 h, and then held at 80° C. for 2 h, thereby obtaining coalesced particles having a volume median particle size ($D_{50}$) of 5.0 μm. Thereafter, the resulting dispersion was cooled to 25° C., during which the aggregated particles (2) were transformed into the coalesced particles.

The resulting coalesced particles were successively subjected to filtration step for solid-liquid separation, drying step and rinsing step, thereby obtaining toner particles. Next, 2.5 parts of a hydrophobic silica "IRY50" (number-average particle size: 0.04 μm) available from Nippon Aerosil Co., Ltd., 1.0 part of a hydrophobic silica "CAB-O-SIL TS-720" (number-average particle size: 0.012 μm) available from Cabot Norit Japan Co. Ltd. and 0.8 part of organic fine particles "FINE SPHERE P2000" (number-average particle size: 0.5 μm) available from Nippon Paint Co., Ltd., were externally added to 100 parts of the toner particles using a Henschel mixer. The resulting mixture was then allowed to pass through a 150 mesh sieve, thereby obtaining a cyan toner as undersize fine particles.

The kinds, properties, etc., of the releasing agent particle dispersion and resin particle dispersion used, as well as properties and evaluation results of the thus obtained toner are shown in Table 5-1.

Examples 2 to 14 and Comparative Examples 1 to 3

Production of Toners 2 to 17

The same procedure as in Example 1 was repeated except that the releasing agent particle dispersion and resin particle dispersion used were replaced with those shown in Tables 5-1 and 5-2, thereby obtaining toners.

The kinds, properties, etc., of the releasing agent particle dispersions and resin particle dispersions used, as well as properties and evaluation results of the thus obtained toners are shown in Tables 5-1 and 5-2.

TABLE 5-1

| | Example 1 | Example 2 | Example 3 | Example 4 | Example 5 |
|---|---|---|---|---|---|
| Toner No. | 1 | 2 | 3 | 4 | 5 |
| Dispersion of releasing agent particles | | | | | |
| Releasing agent particle dispersion No. | W-1 | W-2 | W-3 | W-4 | W-5 |
| Resin particle (A) dispersion No. | A-1 | A-2 | A-3 | A-4 | A-5 |
| Content $S_A$ of aliphatic carboxylic acid component in acid component constituting polyester contained in resin particles (A) (% by mass) | 45 | 51 | 30 | 100 | 1.6 |
| Amount of surfactant based on 100 parts by mass of releasing agent (part(s) by mass) | 0.16 | 0.16 | 0.16 | 0.16 | 0.16 |
| Volume median particle size of resin particles (A) (μm) | 0.12 | 0.11 | 0.10 | 0.11 | 0.10 |
| Volume median particle size of releasing agent particles (μm) | 0.53 | 0.50 | 0.58 | 0.61 | 0.59 |

TABLE 5-1-continued

| | | | | | |
|---|---|---|---|---|---|
| Dispersion of resin particles (B) | | | | | |
| Resin particle dispersion No. | B-1 | B-1 | B-1 | B-2 | B-3 |
| Content $S_B$ of aliphatic carboxylic acid component in acid component constituting polyester contained in resin particles (B) (% by mass) | 45 | 45 | 45 | 91 | 4 |
| Step (2) | | | | | |
| $\lvert S_A - S_B \rvert$ | 0 | 6 | 15 | 9 | 2 |
| Properties of toner | | | | | |
| Volume median particle size (μm) | 5.0 | 5.1 | 5.2 | 5.0 | 5.1 |
| CV (%) | 22 | 23 | 24 | 23 | 23 |
| Evaluation of toner | | | | | |
| Durability: time elapsed until occurrence of unevenness (h) | 1.5 | 1.4 | 1.2 | 1.3 | 1.3 |
| Toner cloud: number of toner particles scattered | 65 | 72 | 61 | 88 | 91 |
| Fusing property: fusing range (° C.) | 140-180 | 140-180 | 140-175 | 135-175 | 135-175 |

| | Example 6 | Example 7 | Example 8 | Example 9 |
|---|---|---|---|---|
| Toner No. | 6 | 7 | 8 | 9 |
| Dispersion of releasing agent particles | | | | |
| Releasing agent particle dispersion No. | W-6 | W-7 | W-9 | W-10 |
| Resin particle (A) dispersion No. | A-6 | A-7 | A-1 | A-1 |
| Content $S_A$ of aliphatic carboxylic acid component in acid component constituting polyester contained in resin particles (A) (% by mass) | 59 | 20 | 45 | 45 |
| Amount of surfactant, based on 100 parts by mass of releasing agent (part(s) by mass) | 0.16 | 0.16 | 0.16 | 0.16 |
| Volume median particle size of resin particles (A) (μm) | 0.15 | 0.16 | 0.12 | 0.12 |
| Volume median particle size of releasing agent particles (μm) | 0.52 | 0.54 | 0.48 | 0.62 |
| Dispersion of resin particles (B) | | | | |
| Resin particle dispersion No. | B-1 | B-3 | B-1 | B-1 |
| Content $S_B$ of aliphatic carboxylic acid component, in acid component, constituting polyester contained in resin particles (B) (% by mass) | 45 | 4 | 45 | 45 |
| Step (2) | | | | |
| $\lvert S_A - S_B \rvert$ | 14 | 16 | 0 | 0 |
| Properties of toner | | | | |
| Volume median particle size (μm) | 4.8 | 5.0 | 4.7 | 4.9 |
| CV (%) | 25 | 24 | 23 | 24 |
| Evaluation of toner | | | | |
| Durability: time elapsed until occurrence of unevenness (h) | 1.1 | 1.0 | 1.4 | 1.2 |
| Toner cloud: number of toner particles scattered | 101 | 135 | 75 | 86 |
| Fusing property: fusing range (° C.) | 140-175 | 140-175 | 135-175 | 140-175 |

TABLE 5-2

| | Example 10 | Example 11 | Example 12 | Example 13 | Example 14 |
|---|---|---|---|---|---|
| Toner No. | 10 | 11 | 12 | 13 | 14 |
| Dispersion of releasing agent particles | | | | | |
| Releasing agent particle dispersion No. | W-11 | W-7 | W-6 | W-8 | W-3 |
| Resin particle (A) dispersion No. | A-1 | A-7 | A-6 | A-8 | A-3 |
| Content $S_A$ of aliphatic carboxylic acid component in acid component constituting polyester contained in resin particles (A) (% by mass) | 45 | 20 | 59 | 67 | 30 |

TABLE 5-2-continued

| | | | | | |
|---|---|---|---|---|---|
| Amount of surfactant based on 100 parts by mass of releasing agent (part(s) by mass) | 0.16 | 0.16 | 0.16 | 0.16 | 0.16 |
| Volume median particle size of resin particles (A) (μm) | 0.12 | 0.16 | 0.15 | 0.14 | 0.10 |
| Volume median particle size of releasing agent particles (μm) | 0.62 | 0.54 | 0.52 | 0.66 | 0.58 |
| Dispersion of resin particles (B) | | | | | |
| Resin particle dispersion No. | B-1 | B-1 | B-2 | B-1 | B-3 |
| Content $S_B$ of aliphatic carboxylic acid component in acid component constituting polyester contained in resin particles (B) (% by mass) | 45 | 45 | 91 | 45 | 4 |
| Step (2) | | | | | |
| $\lvert S_A - S_B \rvert$ | 0 | 25 | 32 | 22 | 26 |
| Properties of toner | | | | | |
| Volume median particle size (μm) | 5.1 | 4.9 | 5.1 | 5.0 | 4.9 |
| CV (%) | 22 | 27 | 25 | 28 | 25 |
| Evaluation of toner | | | | | |
| Durability: time elapsed until occurrence of unevenness (h) | 1.1 | 0.8 | 0.7 | 0.8 | 0.7 |
| Toner cloud: number of toner particles scattered | 122 | 123 | 152 | 166 | 149 |
| Fusing property: fusing range (° C.) | 140-175 | 140-170 | 135-165 | 140-170 | 140-170 |

| | Comparative Example 1 | Comparative Example 2 | Comparative Example 3 |
|---|---|---|---|
| Toner No. | 15 | 16 | 17 |
| Dispersion of releasing agent particles | | | |
| Releasing agent particle dispersion No. | W-12 | W-13 | W-14 |
| Resin particle (A) dispersion No. | — | C | A-9 |
| Content $S_A$ of aliphatic carboxylic acid component in acid component constituting polyester contained in resin particles (A) (% by mass) | — | — | 0 |
| Amount of surfactant based on 100 parts by mass of releasing agent (part(s) by mass) | 1.0 | — | 0.16 |
| Volume median particle size of resin particles (A) (μm) | — | 0.15 | 0.76 |
| Volume median particle size of releasing agent particles (μm) | 0.45 | 0.65 | 1.09 |
| Dispersion of resin particles (B) | | | |
| Resin particle dispersion No. | B-1 | B-1 | B-4 |
| Content $S_B$ of aliphatic carboxylic acid component in acid component constituting polyester contained in resin particles (B) (% by mass) | 45 | 45 | 0 |
| Step (2) | | | |
| $\lvert S_A - S_B \rvert$ | — | — | 0 |
| Properties of toner | | | |
| Volume median particle size (μm) | 5.0 | 5.3 | 5.5 |
| CV (%) | 26 | 25 | 33 |
| Evaluation of toner | | | |
| Durability: time elapsed until occurrence of unevenness (h) | 0.3 | 0.4 | 0.2 |
| Toner cloud: number of toner particles scattered | 326 | 223 | 658 |
| Fusing property: fusing range (° C.) | 140-155 | 140-155 | 140-150 |

From Tables 5-1 and 5-2, it was confirmed that the toners obtained in Examples 1 to 14 all were sufficient in fusing range indicating a fusing property thereof as well as excellent in durability and suppression of toner cloud as compared to the toners obtained in Comparative Examples 1 to 3.

INDUSTRIAL APPLICABILITY

In accordance with the production process of the present invention, the resulting toner is excellent in durability, suppression of toner cloud and fusing property, and therefore can be used as a toner for development of electrostatic images which is suitably used in an electrophotographic method, an electrostatic recording method, an electrostatic printing method, etc.

The invention claimed is:

1. A process for producing a toner for development of electrostatic images, comprising:

(1) mixing and emulsifying a releasing agent and a dispersion of resin particles (A) comprising a polyester in an amount of not less than 90% by mass on the basis of a resin component in the resin particles (A) to obtain a dispersion of releasing agent particles;

(2) mixing and aggregating the dispersion of the releasing agent particles obtained in said (1) mixing and emulsifying and a dispersion of resin particles (B) comprising a polyester in an amount of not less than 90% by mass on the basis of a resin component in the resin particles (B) to obtain aggregated particles; and (3) coalescing the aggregated particles obtained in said (2) mixing and aggregating to obtain coalesced particles, in which an acid component of the polyester in the resin particles (A) comprises an aliphatic carboxylic acid; the resin particles (A) have a volume median particle size of not less than 0.02 μm and not more than 0.50 μm; and a content of a surfactant in the dispersion of the releasing agent particles is not more than 0.5 part by mass on the basis of 100 parts by mass of the releasing agent, wherein said releasing agent and said resin particles (A) are mixed in (1) said mixing in a mass ratio of releasing agent to resin particles (A) of 99/1 to 51/49.

2. The process for producing a toner for development of electrostatic images according to claim 1, wherein in said (2) mixing and aggregating, assuming that a content of the aliphatic carboxylic acid component in the acid component of the polyester in the resin particles (A) and a content of an aliphatic carboxylic acid component in an acid component of the polyester in the resin particles (B) are represented by $S_A$ (% by mass) and $S_B$ (% by mass), respectively, $S_A$ is more than 0, and an absolute value of a difference between $S_A$ and $S_B$ ($|S_A-S_B|$) is not more than 20.

3. The process for producing a toner for development of electrostatic images according to claim 1, wherein the dispersion of resin particles (A) in said (1) mixing and emulsifying is obtained by a phase inversion emulsification method.

4. The process for producing a toner for development of electrostatic images according to claim 1, wherein said (1) mixing and emulsifying is performed in an aqueous medium.

5. The process for producing a toner for development of electrostatic images according to claim 4, wherein a content of water in the aqueous medium is not less than 80% by mass and not more than 100% by mass.

6. The process for producing a toner for development of electrostatic images according to claim 1, wherein in said (1) mixing and emulsifying, the releasing agent and the resin particles (A) are added to the aqueous medium, and the resulting mixture is dispersed while heating at a temperature not lower than a melting point of the releasing agent to obtain a dispersion of releasing agent particles.

7. The process for producing a toner for development of electrostatic images according to claim 6, wherein a heating temperature upon dispersing the mixture is a temperature not lower than a melting point of the releasing agent and not higher than 100° C.

8. The process for producing a toner for development of electrostatic images according to claim 1, wherein a melting point of the releasing agent is not lower than 60° C. and not higher than 100° C.

9. The process for producing a toner for development of electrostatic images according to claim 1, wherein the content $S_A$ (% by mass) of the aliphatic carboxylic acid component in the acid component of the polyester in the resin particles (A) is not less than 1% by mass and not more than 100% by mass.

10. The process for producing a toner for development of electrostatic images according to claim 1, wherein the releasing agent comprises a vegetable wax and a mineral or petroleum wax.

11. The process for producing a toner for development of electrostatic images according to claim 1, wherein the dispersion of the releasing agent particles is obtained by dispersing the releasing agent and the aqueous medium in the presence of the resin particles (A) at a temperature not lower than a melting point of the releasing agent by using a disperser.

12. The process for producing a toner for development of electrostatic images according to claim 1, wherein the aliphatic carboxylic acid component in the acid component of the polyester in the resin particles (A) comprises at least one acid selected from the group consisting of fumaric acid, adipic acid, succinic acid and succinic acids substituted with an alkenyl group having not less than 2 and not more than 20 carbon atoms.

13. The process for producing a toner for development of electrostatic images according to claim 1, wherein a mass ratio of the releasing agent to the resin particles (A) [releasing agent/resin particles (A)] is from 99/1 to 51/49.

14. The process for producing a toner for development of electrostatic images according to claim 1, wherein the dispersion of the resin particles (A) comprises water in an amount of not less than 90% by mass on the basis of a dispersing medium therein.

15. The process for producing a toner for development of electrostatic images according to claim 1, wherein the dispersion of the resin particles (B) comprises water in an amount of not less than 90% by mass on the basis of a dispersing medium therein.

16. The process for producing a toner for development of electrostatic images according to claim 1, wherein the releasing agent particles have a volume median particle size of not less than 0.05 μm and not more than 1.00 μm.

17. The process for producing a toner for development of electrostatic images according to claim 1, wherein an alcohol component of the polyester in the resin particles (A) comprises an aromatic diol; and wherein the aromatic diol is an alkylene (having not less than 2 and not more than 3 carbon atoms) oxide adduct (average molar number of addition of alkyleneoxide: not less than 1 and not more than 16) of bisphenol A.

18. A process for producing a dispersion of releasing agent particles, comprising:

mixing and emulsifying a releasing agent and a dispersion of resin particles (A) comprising a polyester in an amount of not less than 90% by mass on the basis of a resin component in the resin particles (A) to obtain the dispersion of the releasing agent particles, in which an acid component of the polyester in the resin particles (A) comprises an aliphatic carboxylic acid; the resin particles (A) have a volume median particle size of not less than 0.02 μm and not more than 0.50 μm; and a content of a surfactant in the dispersion of the releasing agent particles is not more than 0.5 part by mass on the basis of 100 parts by mass of the releasing agent, wherein said releasing agent and said resin particles (A) are mixed in (1) said mixing and emulsifying in a mass ratio of releasing agent to resin particles (A) of 99/1 to 51/49.

19. The process for producing a toner for development of electrostatic images according to claim 6, wherein a heating temperature upon dispersing the mixture is a temperature not lower than 80° C. and not higher than 100° C.

* * * * *